US009358167B2

(12) United States Patent
LaPointe et al.

(10) Patent No.: US 9,358,167 B2
(45) Date of Patent: Jun. 7, 2016

(54) FURNITURE MEMBER POWER MECHANISM WITH SELECTABLE LIFT MOVEMENT AND ZERO GRAVITY POSITION

(71) Applicant: La-Z-Boy Incorporated, Monroe, MI (US)

(72) Inventors: Larry P. LaPointe, Temperance, MI (US); Alexander M. Hegedus, Toledo, OH (US); Eric B. Harwood, Toledo, OH (US)

(73) Assignee: La-Z-Boy Incorporated, Monroe, MI (US)

( * ) Notice: Subject to any disclaimer, the term of this patent is extended or adjusted under 35 U.S.C. 154(b) by 187 days.

(21) Appl. No.: 14/227,837

(22) Filed: Mar. 27, 2014

(65) Prior Publication Data

US 2015/0076891 A1 Mar. 19, 2015

Related U.S. Application Data

(63) Continuation-in-part of application No. 14/031,446, filed on Sep. 19, 2013, now Pat. No. 9,010,851.

(51) Int. Cl.
*A47C 1/035* (2006.01)
*A47C 1/0355* (2013.01)
(Continued)

(52) U.S. Cl.
CPC . *A61G 5/14* (2013.01); *A47C 1/029* (2013.01); *A47C 1/0355* (2013.01); *A47C 1/03211* (2013.01); *A47C 31/008* (2013.01); *Y10T 74/20341* (2015.01)

(58) Field of Classification Search
CPC .... A47C 31/008; A47C 1/029; A47C 1/0355; A47C 1/03211; A61G 5/14
USPC ..... 297/85 M
See application file for complete search history.

(56) References Cited

U.S. PATENT DOCUMENTS 4,690,457 A 9/1987 Poncy et al.
4,752,101 A 6/1988 Yurchenco et al.
(Continued)

FOREIGN PATENT DOCUMENTS

GB 2485434 A 5/2012

OTHER PUBLICATIONS

International Search Report for PCT/US2012/052069 dated Feb. 19, 2013.
(Continued)

*Primary Examiner* — Rodney B White
(74) *Attorney, Agent, or Firm* — Harness, Dickey & Pierce, P.L.C.

(57) ABSTRACT

A furniture member has a base frame including first and second frame members each having a first or second frame support tube. A mechanism includes a motor connected to the base frame and a torque tube connected to first and second support brackets and the motor. A stiffening tube assembly has first and second side stiffening tubes, the first frame support tube connected to the first side stiffening tube and the second frame support tube connected to the second side stiffening tube. Multiple rotation links include a first set connected to the first frame support tube and the first side stiffening tube, and a second set connected to the second frame support tube and the second side stiffening tube. The rotation links allow mechanism rotation to a forward lift position by motor operation displacing the torque tube and thereby forwardly rotating and lifting the side stiffening tubes.

29 Claims, 27 Drawing Sheets

(51) Int. Cl.

| | |
|---|---|
| ***A61G 5/14*** | (2006.01) |
| ***A47C 31/00*** | (2006.01) |
| ***A47C 1/029*** | (2006.01) |
| ***A47C 1/032*** | (2006.01) |

(56) References Cited

U.S. PATENT DOCUMENTS

| | | | | | |
|---|---|---|---|---|---|
| 4,852,939 | A | * | 8/1989 | Krauska | A47C 1/0242 297/85 M X |
| 5,061,010 | A | | 10/1991 | LaPointe | |
| 5,222,286 | A | | 6/1993 | Saul et al. | |
| 5,265,935 | A | | 11/1993 | Geisler et al. | |
| 5,288,126 | A | | 2/1994 | Saul et al. | |
| 5,314,238 | A | | 5/1994 | Komorowski et al. | |
| 5,466,046 | A | | 11/1995 | Komorowski et al. | |
| 5,482,350 | A | | 1/1996 | Komorowski et al. | |
| 5,520,439 | A | | 5/1996 | Blount | |
| 5,524,303 | A | | 6/1996 | Palmer, Jr. et al. | |
| 5,651,580 | A | | 7/1997 | LaPointe et al. | |
| 5,730,494 | A | * | 3/1998 | LaPointe | A61G 5/14 297/85 M X |
| 5,747,965 | A | | 5/1998 | LaPointe et al. | |
| 5,806,920 | A | | 9/1998 | Blount | |
| 5,992,931 | A | * | 11/1999 | LaPointe | A47C 1/0345 297/85 M X |
| 6,338,531 | B1 | | 1/2002 | Hausherr et al. | |
| 6,491,342 | B1 | | 12/2002 | Smith | |
| 6,492,786 | B1 | | 12/2002 | Vang et al. | |
| 6,659,556 | B2 | | 12/2003 | Pellerin | |
| 6,794,841 | B1 | | 9/2004 | Vang et al. | |
| 6,823,545 | B1 | | 11/2004 | Davis | |
| 7,000,988 | B2 | | 2/2006 | Bressler et al. | |
| 7,090,297 | B2 | | 8/2006 | Mohn et al. | |
| 7,311,359 | B2 | | 12/2007 | Smith | |
| 7,455,360 | B2 | | 11/2008 | White et al. | |
| 7,600,817 | B2 | | 10/2009 | Kramer et al. | |
| 7,722,114 | B2 | | 5/2010 | Smith | |
| 7,766,421 | B2 | | 8/2010 | Lawson | |
| 7,850,238 | B2 | | 12/2010 | Erb et al. | |
| 8,419,122 | B2 | * | 4/2013 | Lawson | A47C 1/035 297/85 M X |
| 8,696,054 | B2 | * | 4/2014 | Crum | A47C 1/0355 297/83 |
| 2006/0061148 | A1 | * | 3/2006 | Pollard | A47C 1/0355 297/85 M |
| 2011/0181094 | A1 | * | 7/2011 | Lawson | A47C 1/035 297/85 R |
| 2012/0299363 | A1 | * | 11/2012 | Crum | A47C 1/0355 297/85 M |
| 2013/0175847 | A1 | * | 7/2013 | Lawson | A61G 5/14 297/85 M |

OTHER PUBLICATIONS

Written Opinion of the International Searching Authority for PCT/US2012/052069 mailed Feb. 19, 2013.

* cited by examiner

FURNITURE MEMBER POWER MECHANISM WITH SELECTABLE LIFT MOVEMENT AND ZERO GRAVITY POSITION

CROSS-REFERENCE TO RELATED APPLICATIONS

This application is a continuation-in-part of U.S. patent application Ser. No. 14/031,446, filed on Sep. 19, 2013. The entire disclosure of the above application is incorporated herein by reference.

FIELD

The present disclosure relates to power lift furniture members having power mechanisms to move components of the furniture member.

BACKGROUND

This section provides background information related to the present disclosure which is not necessarily prior art.

Furniture members such as recliners, sofas, love seats, and ottomans commonly provide a structural frame supporting a body, which allows the body to displace forwardly from an upright or seated operating position to a lift position, which raises an occupant of the furniture member to an elevated position approximating a standing position. The lift mechanism is powered to assist the occupant who may not be able to stand effectively from the furniture member normal upright position. Known mechanisms allowing such lift travel do not however also permit a rearward tilt motion of the body to a zero gravity position while still maintaining wall clearance at all seat back member positions.

SUMMARY

This section provides a general summary of the disclosure, and is not a comprehensive disclosure of its full scope or all of its features.

According to several aspects, a furniture member having an occupant lift position includes a base frame including a first frame member having a first frame support tube fixed thereto and a second frame member having a second frame support tube fixed thereto. A mechanism connected to the base frame includes a motor connected to the base frame and a torque tube connected to first and second support brackets and to the motor. A stiffening tube assembly has first and second side stiffening tubes, the first frame support tube connected to the first side stiffening tube and the second frame support tube connected to the second side stiffening tube. Multiple rotation links include a first set rotatably connected to the first frame support tube and to the first side stiffening tube, and a second set rotatably connected to the second frame support tube and to the second side stiffening tube. The multiple rotation links allow rotation of the mechanism to at least a forward lift position by operation of the motor acting to displace the torque tube and thereby to forwardly rotate and lift the first and second side stiffening tubes.

According to further aspects, a furniture member has a base frame including a first frame member having a first frame support tube fixed thereto and a second frame member having a second frame support tube fixed thereto. Each of the first and second frame support tubes has an upward directed bend at a rear facing end thereof. A mechanism connected to the base frame includes a motor and a torque tube connected to first and second support brackets and to the motor such that the torque tube is displaced by operation of the motor. A stiffening tube assembly has first and second side stiffening tubes, the first frame support tube connected to the first side stiffening tube and the second frame support tube connected to the second side stiffening tube. A first rotation link is rotatably connected to a front facing end of the first frame support tube, and a second rotation link is rotatably connected to the upward directed bend of the first frame support tube. A third rotation link is rotatably connected to a front facing end of the second frame support tube, and a fourth rotation link is rotatably connected to the upward directed bend of the second frame support tube. The multiple rotation links allow rotation of the mechanism to at least a forward lift position by operation of the motor acting to displace the torque tube and thereby to displace the first and second side stiffening tubes.

According to still further aspects, a furniture member includes a base frame supporting the furniture member on a floor surface. The base frame includes a first frame member having a first frame support tube fixed thereto and a second frame member having a second frame support tube fixed thereto. Each of the first and second frame support tubes has an upward directed bend at a rear facing end thereof. A first mechanism includes a first motor rotatably connected to the base frame and a torque tube displaced by operation of the first motor. A stiffening tube assembly has first and second side stiffening tubes, the first frame support tube connected to the first side stiffening tube and the second frame support tube connected to the second side stiffening tube. A second mechanism supported by the stiffening tube assembly has a second motor. Multiple rotation links include a first set rotatably connected to the first frame support tube and to the first side stiffening tube, and a second set rotatably connected to the second frame support tube and to the second side stiffening tube. The multiple rotation links allow rotation of the mechanism to at least a forward lift position by operation of the first motor acting to displace the torque tube and thereby to forwardly rotate and lift the first and second side stiffening tubes.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
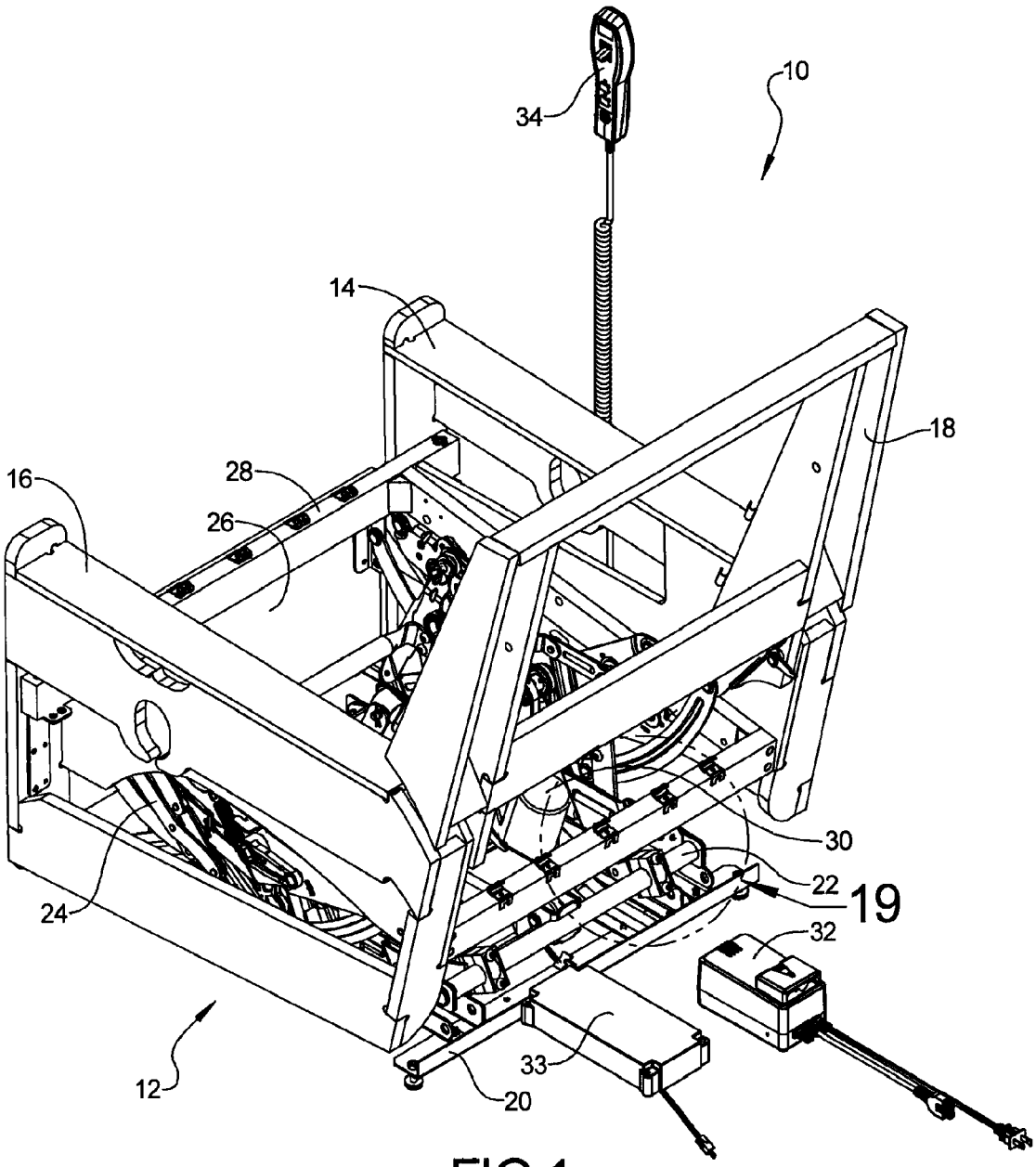
FIG. 1 is a rear perspective view looking forward of a furniture member power mechanism with zero gravity and rear tilt positions.

Referring to FIG. 1, a furniture member 10, which is depicted as a rocking reclining chair, includes a base member 12 which defines a frame, for example, made of wood or a combination of wood and composite materials that includes each of a first arm rest member 14, defining a right side of furniture member 10 with respect to an occupant seated in the furniture member, and a second armrest member 16, defining a left side. A seat back member 18 is rotatably disposed with respect to the base member 12. The base member 12 and the seat back member 18 are supported on a base frame 20 which can be made, for example, from wood and/or from metal, and according to aspects shown is created of metal "L-shaped" members fastened to each other. The base member 12 is rotatable with respect to base frame 20, and can further both tilt and be forwardly displaced by motion with respect to a pivot tube 22. Pivot tube 22 is located proximate to a rear cross member portion of the base frame 20.

To support the legs of an occupant of furniture member 10, a leg rest linkage assembly 24 is disposed within the base member 12 and is operated to extend or retract a leg rest member 26, shown in a retracted or stowed position. The leg rest linkage assembly 24 in the leg rest stowed position is positioned below a seat frame 28 which connectively joins the first and second arm rest members 14, 16. A tilt function of furniture member 10, which will be described in greater detail in reference to FIGS. 4-5, rotates and displaces base member 12 by motion of pivot tube 22, is directed by actuation of a tilt and lift first motor 30, which is also positioned within base member 12, and is connected to the base frame 20. According to several aspects, first motor 30 is a DC electrical motor. Power to energize first motor 30 is provided via a power converter 32 which can be plugged into a household electrical outlet. Power converter 32 converts household 115 VAC electrical power to DC electrical power for use by first motor 30. A controller 33 is also provided which assists in operation at a lift position shown and described in reference to FIGS. 12-15. For independent operation of the various motions of furniture member 10, a control device 34, such as a handheld switching device, is provided.

Referring to FIG. 2 and again to FIG. 1, the furniture member 10 is shown in an upright position having the leg rest member 26 at its stowed position and the seat back member 18 in a fully upright position, which is reached by rotation of the seat back member 18 with respect to a forward rotation direction "A". The base frame 20 further includes extended support legs 35, 35' (only the right side support leg 35 is clearly visible in this view) and opposed side frame members 36, 36' (only one of which is visible in this view), each of which is further provided with one of a plurality of height adjustable support feet 38 which allow the orientation of base frame 20 and therefore furniture member 10 to be adjusted with respect to a floor surface 40. In the furniture member upright position, a rearmost point 42 of furniture member 10, defined as an upper rear corner of the seat back member 18, is positioned with respect to a plane 44 which is spaced from a wall surface 46 defining a nominal wall clearance dimension (WCnom), which allows clearance for upholstery (not shown) and for subsequent rotation and movement of the seat back member 18 during the various operating modes of furniture member 10.

Figure 2:
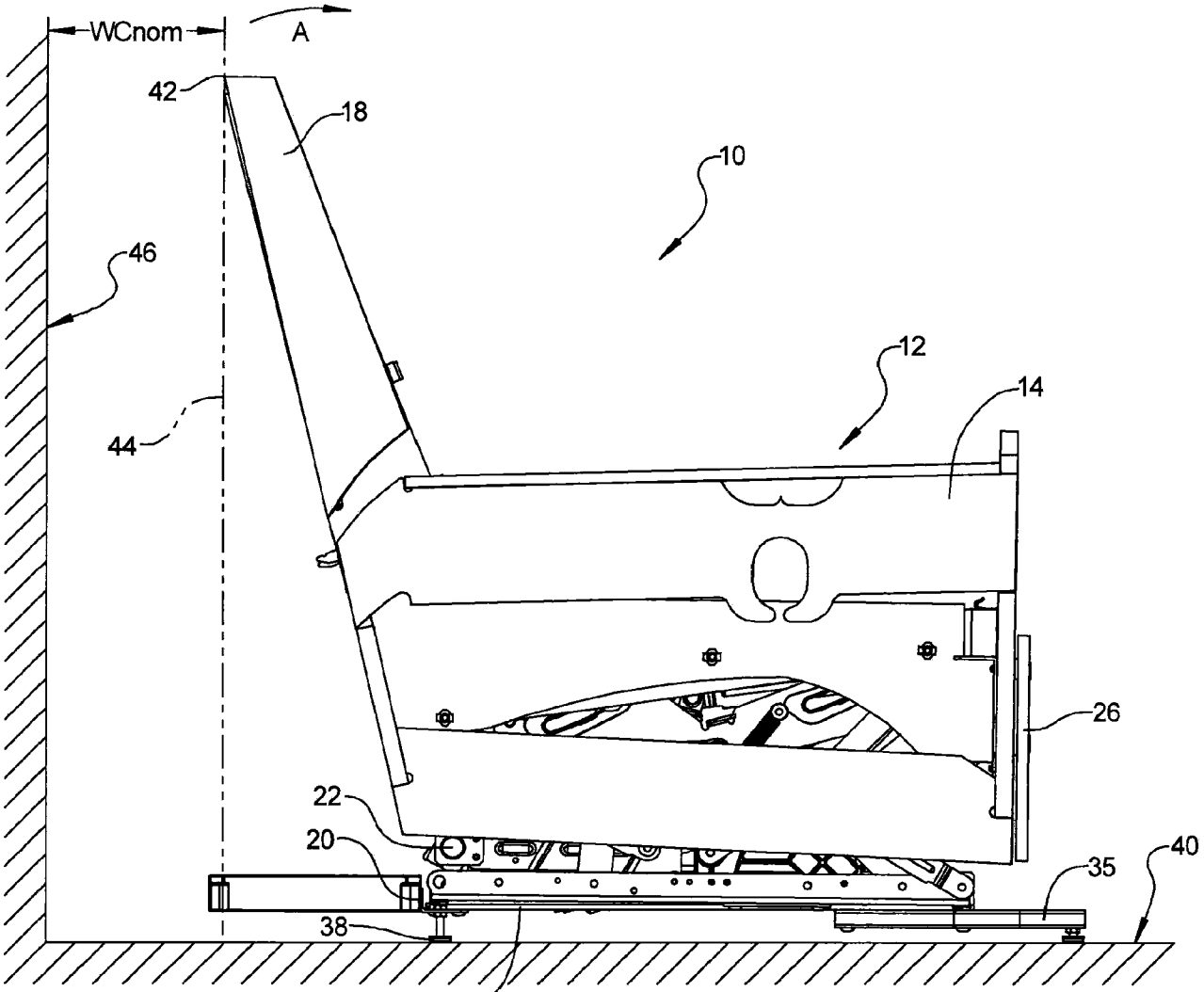
FIG. 2 is a right side elevational view of the furniture member of FIG. 1.

Referring to FIG. 3 and again to FIGS. 1 and 2, components associated with the tilt operation define a first mechanism 47 that includes first motor 30 and each of a drive housing 48 (which directly supports the first motor 30), a shaft housing 50 (directly connected to the drive housing 48), and an extension shaft 52 (extensible and retractable from shaft housing 50), which is shown in its fully retracted position and positioned therefore substantially within the shaft housing 50. The extension shaft 52 is connected to a coupling end 54 whose function will be better described in reference to FIG. 4. According to several aspects, the first motor 30 and the associated components of first mechanism 47 are positioned to one side of a lateral centerline 55 of furniture member 10 and are connected in part to and supported on the base frame 20.

The side positioning of the first motor 30 and first mechanism 47 with respect to lateral centerline 55 provides space between first and second armrest members 14, 16 for a centralized position of a drive or second mechanism 57. Second mechanism 57 includes a drive or second motor 56 which is responsible for extension and retraction of the leg rest member 26 as well as rotation of the seat back member 18. The components of second mechanism 57 are connected to and therefore displace during motion directed by the first mechanism 47. The second motor 56 is also a DC electric motor and is directly connected to a drive housing 58. A slide assembly 60 is slidably disposed on a slide frame 62 which is operably coupled to the drive housing 58. A gear assembly, such as a worm gear (not shown) provided within the slide frame 62, causes an axial, sliding displacement of the slide assembly 60 during operation of second motor 56. Second motor 56 can be operated at the same time as first motor 30 or can be operated separately from first motor 30. The slide assembly 60 is connected to and displaces each of a leg rest linkage assembly 24*a* and a leg rest linkage assembly 24*b*, defining right hand and left hand portions of the leg rest linkage assembly 24. The second motor 56 is rotatably coupled to pivot tube 22 using a pivot mount 64 to allow for rotation of second motor 56 during the various operating modes of furniture member 10.

Figure 3:
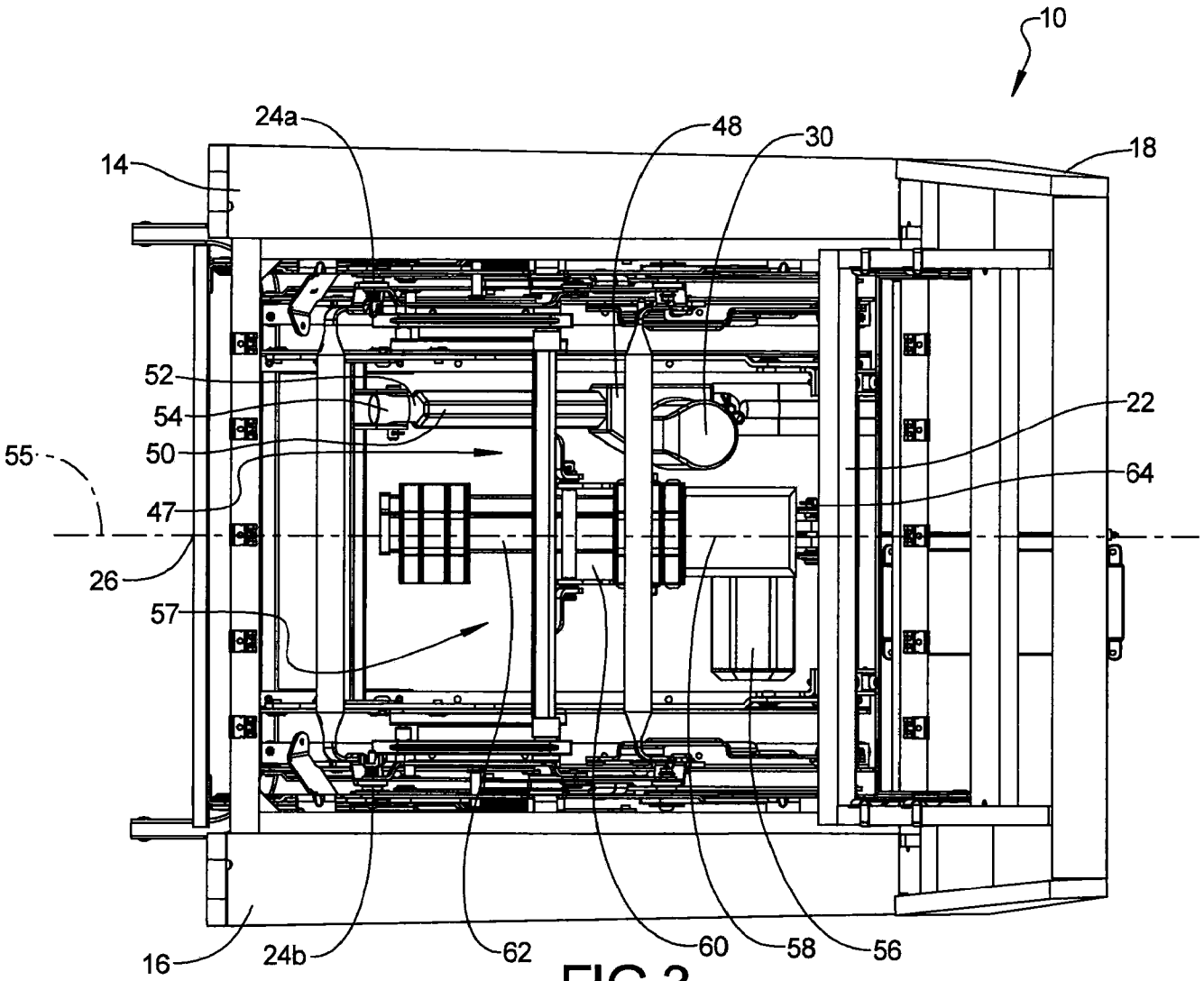
FIG. 3 is a top plan view of the furniture member of FIG. 1.

Referring to FIG. 4 and again to FIGS. 1-3, furniture member 10 is shown following operation of the components of first mechanism 47 including first motor 30, which repositions the furniture member 10 away from the upright position, shown with respect to FIGS. 1-3, to a rear tilt position (shown). Operation of first motor 30 causes axial forward extension of extension shaft 52 which is rotatably connected to a coupling bracket 66 which is connected to base frame 20. During tilt operation mode, axial extension of extension shaft 52 causes base member 12 to displace in a forward displacement direction "B" with respect to the base frame 20. Base member 12 also rearwardly tilts in a rearward rotational arc "C" by operation of first motor 30. A rear tilt position (shown) has the pivot tube 22 positioned below a torque tube 122, 124 (shown and described in reference to FIGS. 15-16).

In order to couple the pivot tube 22 to the base frame 20, a first journal bearing 68 and a second journal bearing 70 are fastened to the pivot tube 22. Each of the first and second journal bearings 68, 70 are connected using a first journal link 72 and a second journal link 74, respectively, to individual ones of a first link connecting plate 76 and a second link connecting plate 78. The first link connecting plate 76 is fixed to a first L-shaped frame member 80 of base frame 20. Similarly, the second link connecting plate 78 is fixed to a second L-shaped frame member 82 of base frame 20. The use of the first and second journal bearings 68, 70 permits the pivot tube 22 to both axially rotate (providing for the tilt motion) and longitudinally displace (providing displacement in forward displacement direction "B") during operation of first motor 30, which will be described in greater detail in reference to FIGS. 14-17.

Figure 4:
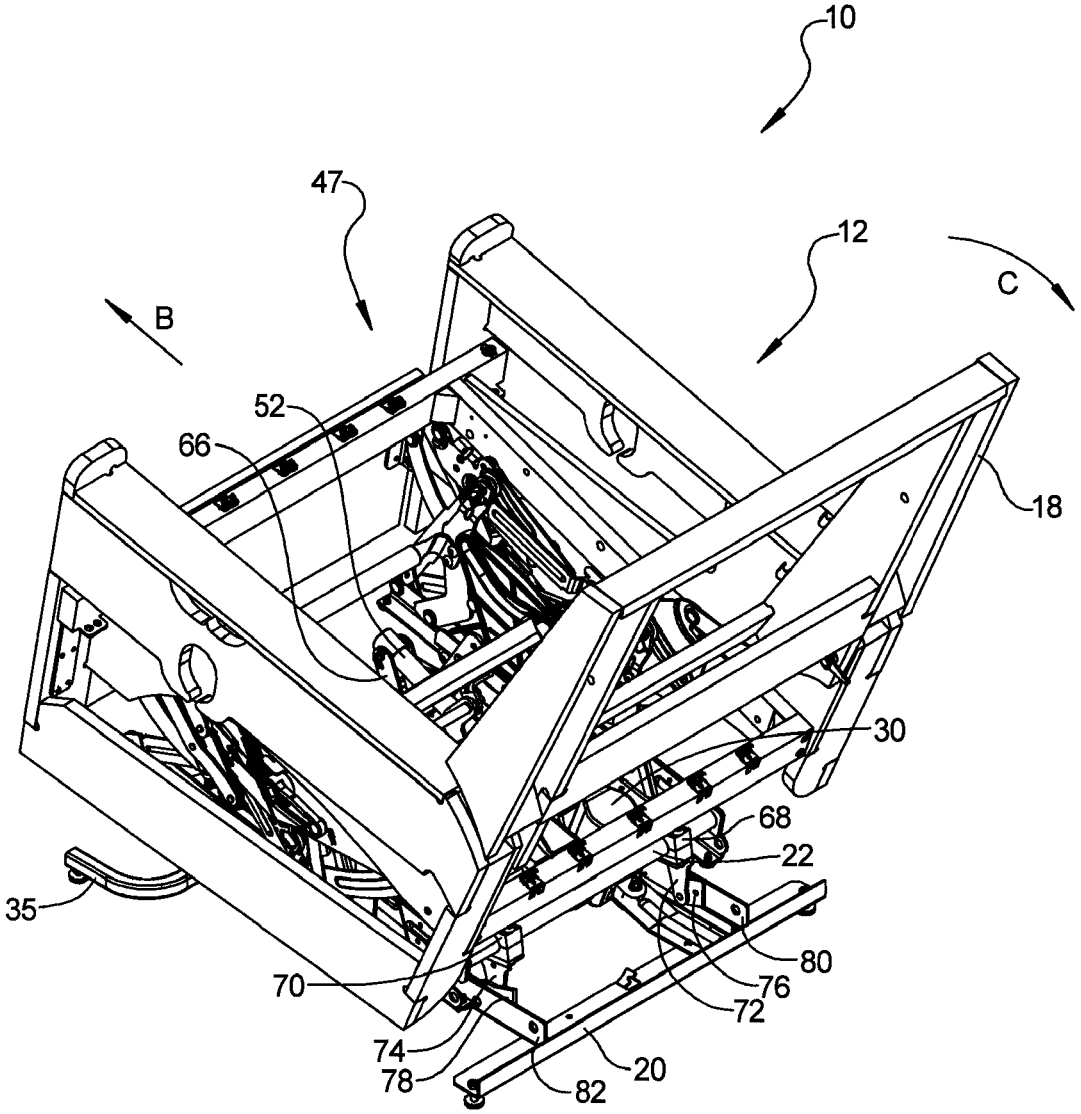
FIG. 4 is a rear perspective view looking forward of the furniture member of FIG. 1 repositioned to a rear tilt position.

Referring to FIG. 5 and again to FIGS. 2 and 4, as base member 12 rotates rearwardly with respect to the rearward rotational arc "C" during operation of first motor 30, the seat back member 18 is retained in its fully upright position. Because base member 12 can displace forwardly in the forward displacement direction "B" at the same time that tilt rotation is occurring, the rearmost point 42 does not substantially displace closer to the wall surface 46, thereby providing a wall clearance dimension $WC_1$ which is substantially unchanged from the wall clearance nominal dimension WCnom shown with respect to FIG. 2. To achieve the tilt position of base member 12, operation of first motor 30 causes rotation of a first rotation link 84 (a second rotation link 84' positioned on the left side is not clearly visible in this view) which rotates with respect to a first rotational fastener 86 connected to the first L-shaped frame member 80. The forward rotation of the first rotation link 84 changes an orientation of a base member lower surface 88 of base member 12, which raises a base member lower front corner 90 above a base member lower rear corner 92. This orientation of base member lower surface 88 creates an angle of rotation or first tilt angle alpha ($\alpha$) between the base member lower surface 88 and the floor surface 40. As previously noted, during tilt operation, the pivot tube 22 will also displace generally in the forward displacement direction "B". This also helps ensure that the wall clearance $WC_1$ between the furniture member and wall surface 46 is substantially unchanged from wall clearance WCnom.

Figure 5:
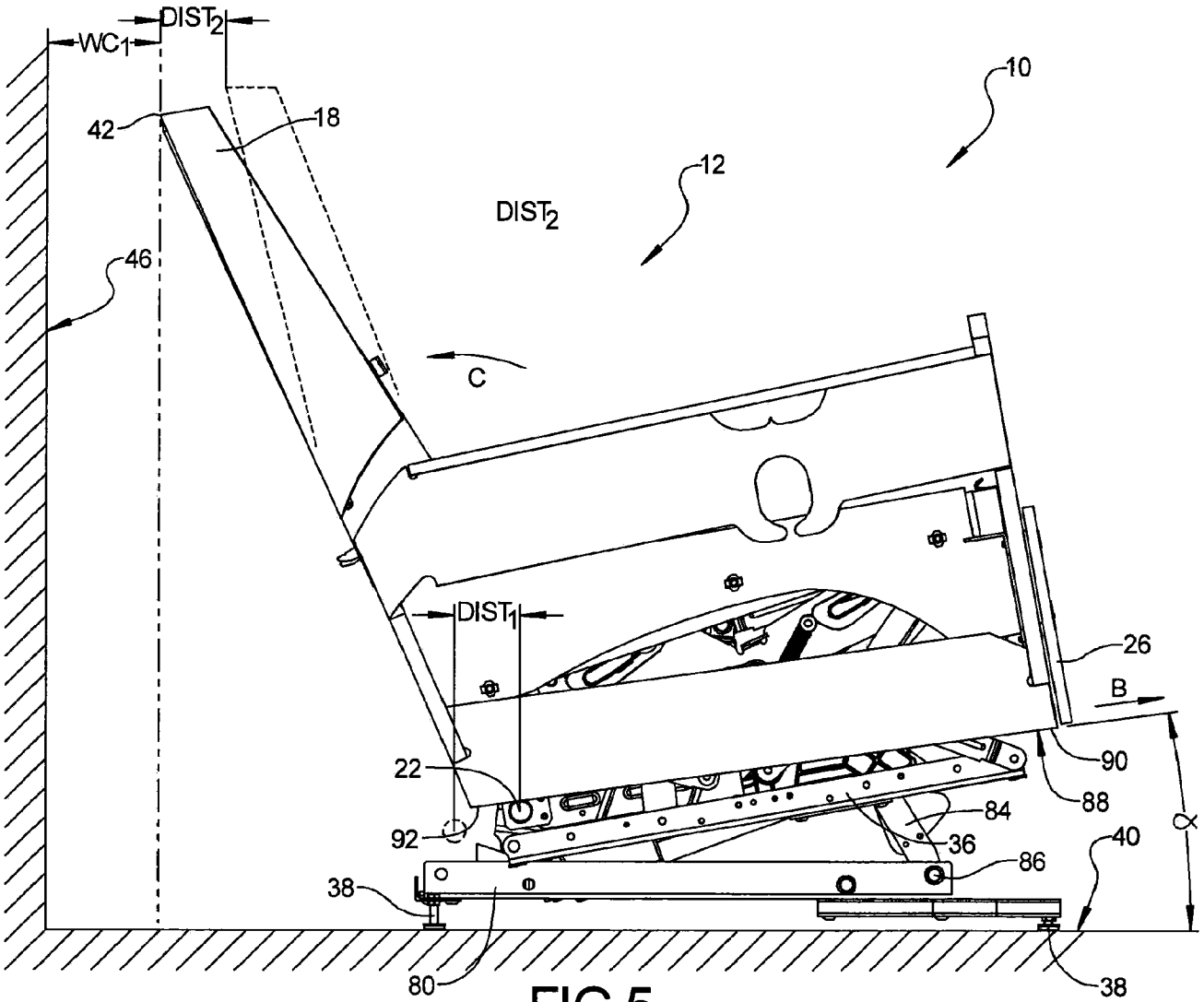
FIG. 5 is a right side elevational view of the furniture member at the rear tilt position of FIG. 4.

As further shown in FIG. 5, a first distance "$Dist_1$" of forward displacement of the pivot tube 22 during operation of the first motor 30 is substantially equal to a second distance "$Dist_2$". Second distance "$Dist_2$" is defined as the rearward displacement of the rearmost point 42 of seat back member 18 of the furniture member 10 connected to the base member 12 due to rearward rotation of the furniture member 10 during rotation to the rear tilt position. Because first distance "$Dist_1$" substantially equals second distance "$Dist_2$" clearance (wall clearance $WC_1$) between the rearmost point 42 and the wall surface 46 proximate to the furniture member is retained between the upright position of the furniture member shown in FIG. 2 (having wall clearance WCnom) and the rear tilt position (having wall clearance $WC_1$) of the furniture member.

Referring to FIG. 6 and again to FIG. 5, with the furniture member 10 positioned in the tilt position, the occupant can select operation of second motor 56 which, when actuated, slidably displaces the slide assembly 60 forward, as previously described. The slide assembly 60 is linked using a rotational bracket assembly 94 to a drive rod 96. Opposite ends of drive rod 96 are slidably positioned in opposed V-shaped slots 98 (only a right hand V-shaped slot 98 is visible in this view). The V-shaped slots 98 are created in a first wall member 100 connected to each of the first and second armrest members 14, 16 of furniture member 10. As the rotational bracket assembly 94 displaces with respect to forward motion of the slide assembly 60, the drive rod 96 is repositioned from a rear end of the V-shaped slot 98 to a central lower position of V-shaped slot 98 (shown). During this translation of drive rod 96 within V-shaped slot 98, each of the leg rest linkage assemblies 24*a*, 24*b* forwardly and outwardly extend in a leg rest extension direction "D", repositioning the leg rest member 26 from the stowed to a fully extended position (shown). It is noted that the leg rest member 26 fully extended position is available in the furniture member tilt position (shown).

Figure 6:
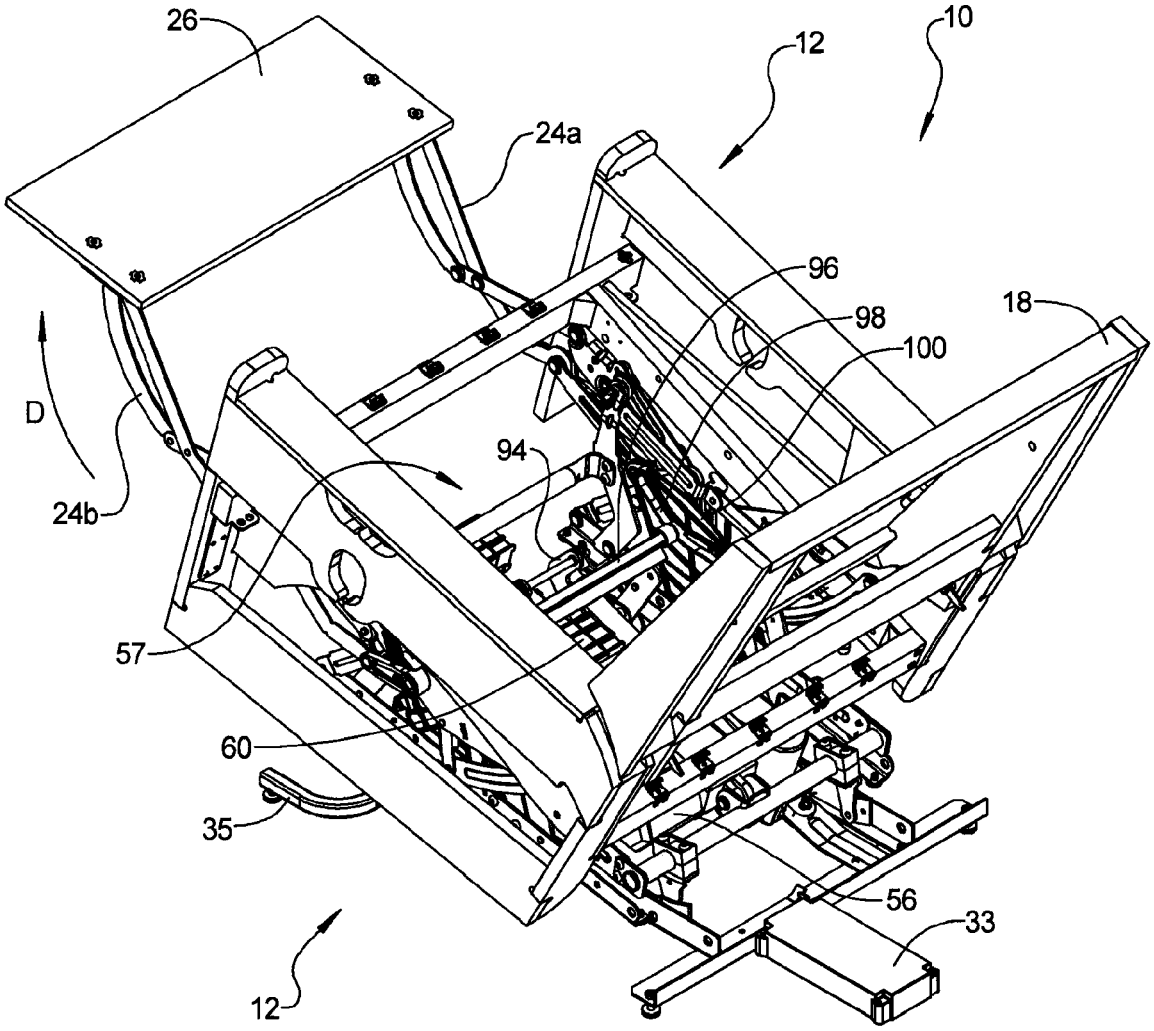
FIG. 6 is a rear perspective view looking forward of the furniture member rear tilt position of FIG. 4 further showing a leg rest assembly fully extended position.
Figure 7:
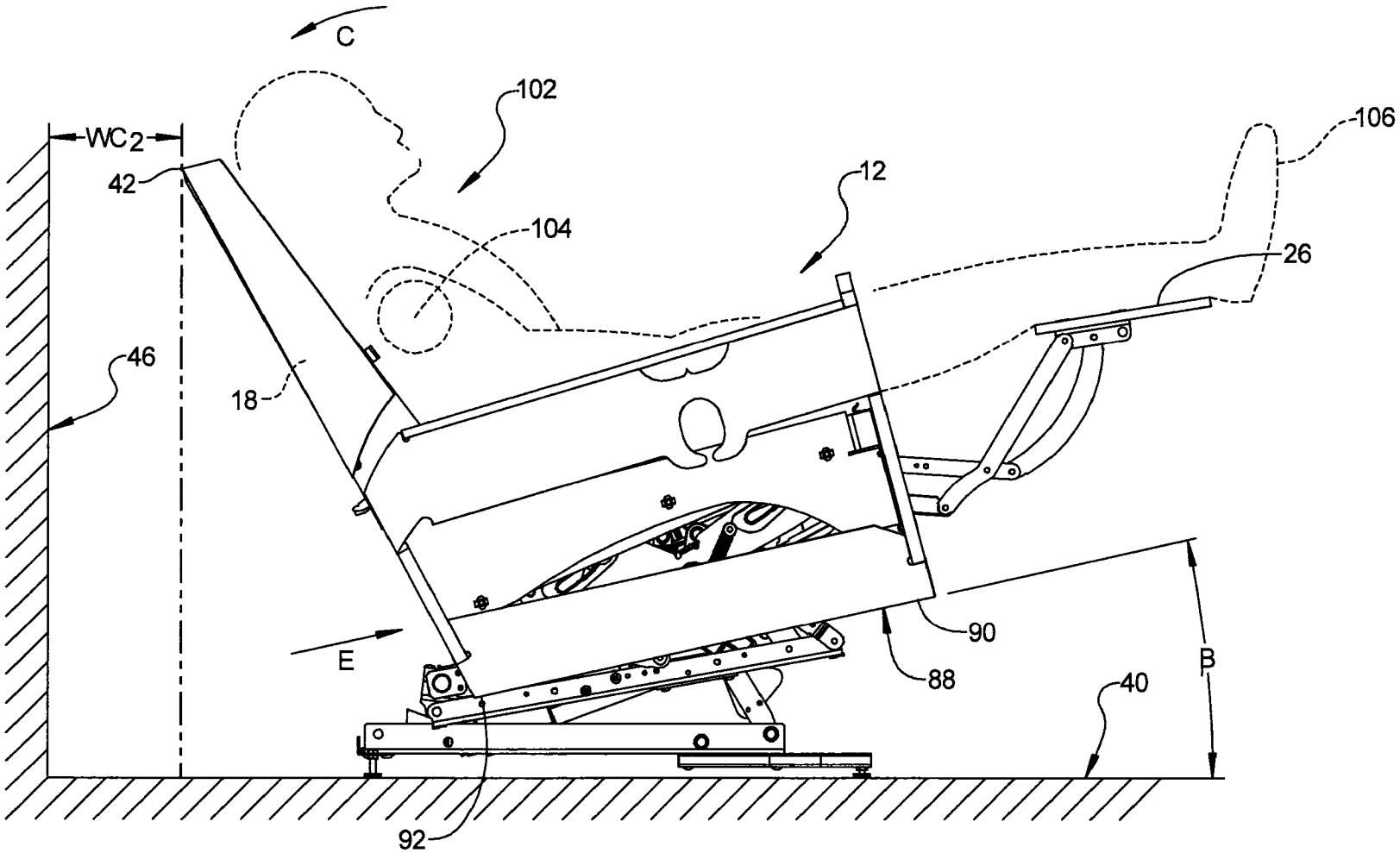
FIG. 7 is a right side elevational view of the furniture member at the rear tilt and leg rest fully extended position of FIG. 6.

Referring to FIG. 7 and again to FIGS. 5 and 6, additional displacement of the base member 12 in a forward elevation/extension direction "E" occurs during leg rest extension. Because the seat back member 18 is retained in its fully upright position during this operation, a wall clearance dimension $WC_2$ is defined when the base member 12 reaches the tilt position, and the leg rest member 26 is positioned in its fully extended position. As the leg rest member 26 reaches the fully extended position, the base member lower surface 88 creates a second tilt angle $\beta$ (beta) with respect to the floor surface 40. According to several aspects, second tilt angle $\beta$ (beta) is greater than first tilt angle $\alpha$ (alpha) which is provided during seat tilt only. The additional seat tilt provided at the achieved position of second tilt angle $\beta$ (beta) helps to position an occupant 102 of furniture member 10 such that a heart elevation 104 of the occupant 102 is positioned substantially level with or below a foot elevation 106 of the occupant 102. As shown in FIG. 7, the base member lower front corner 90 is additionally elevated with respect to the base member lower rear corner 92. In addition, base member lower rear corner 92 is further lowered in elevation with respect to the first tilt position shown and described in reference to FIG. 5.

Referring to FIG. 8 and again to FIGS. 6 and 7, as previously noted, operation of second motor 56 causes forward displacement of the slide assembly 60 in a slide displacement direction "F". A corresponding forward displacement of the drive rod 96 simultaneously occurs with the forward displacement of slide assembly 60. Operation of the second motor 56 can be stopped when the leg rest member 26 reaches its fully extended position (shown).

Figure 8:
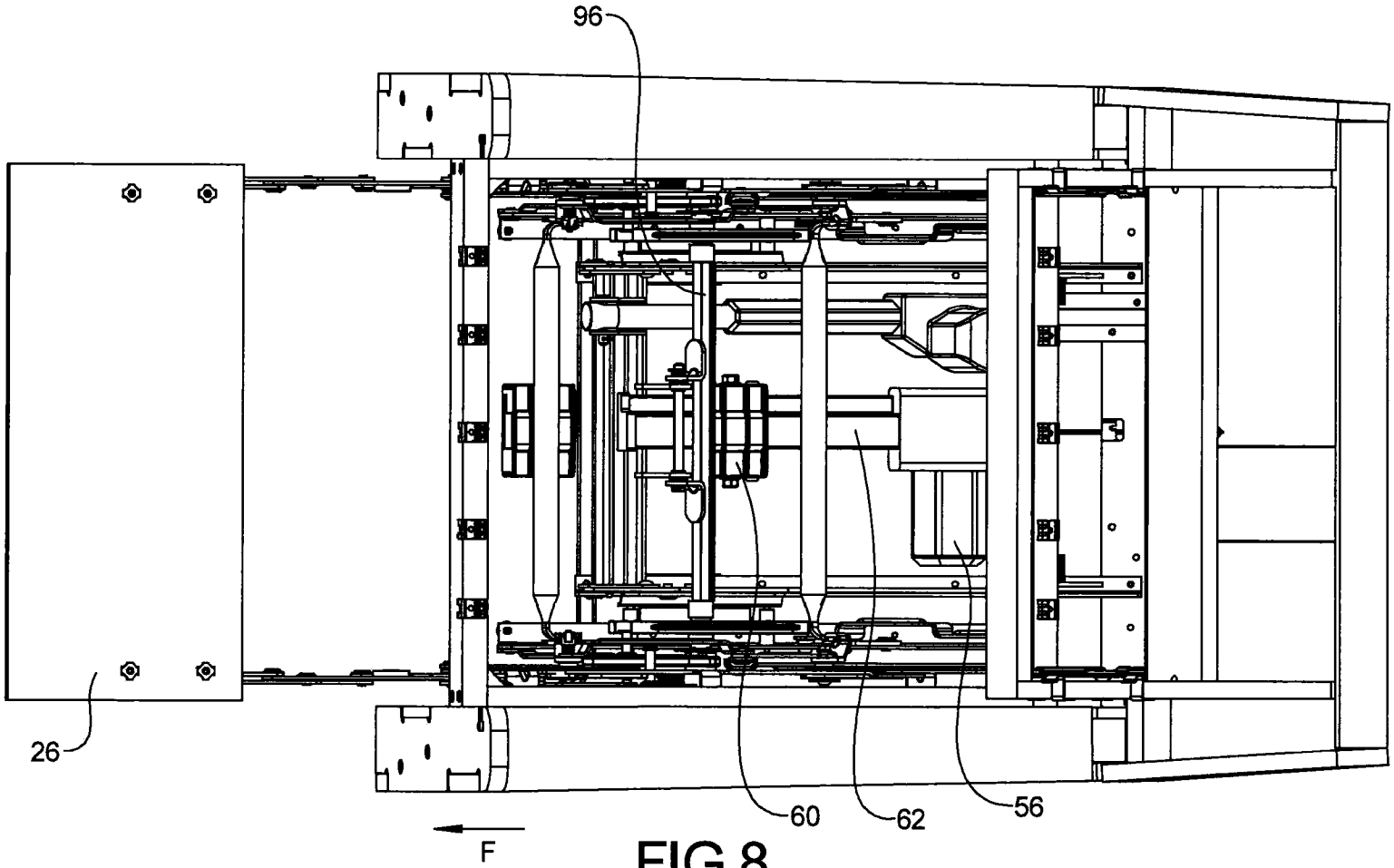
FIG. 8 is a top plan view of the furniture member of FIG. 6.
Figure 9:
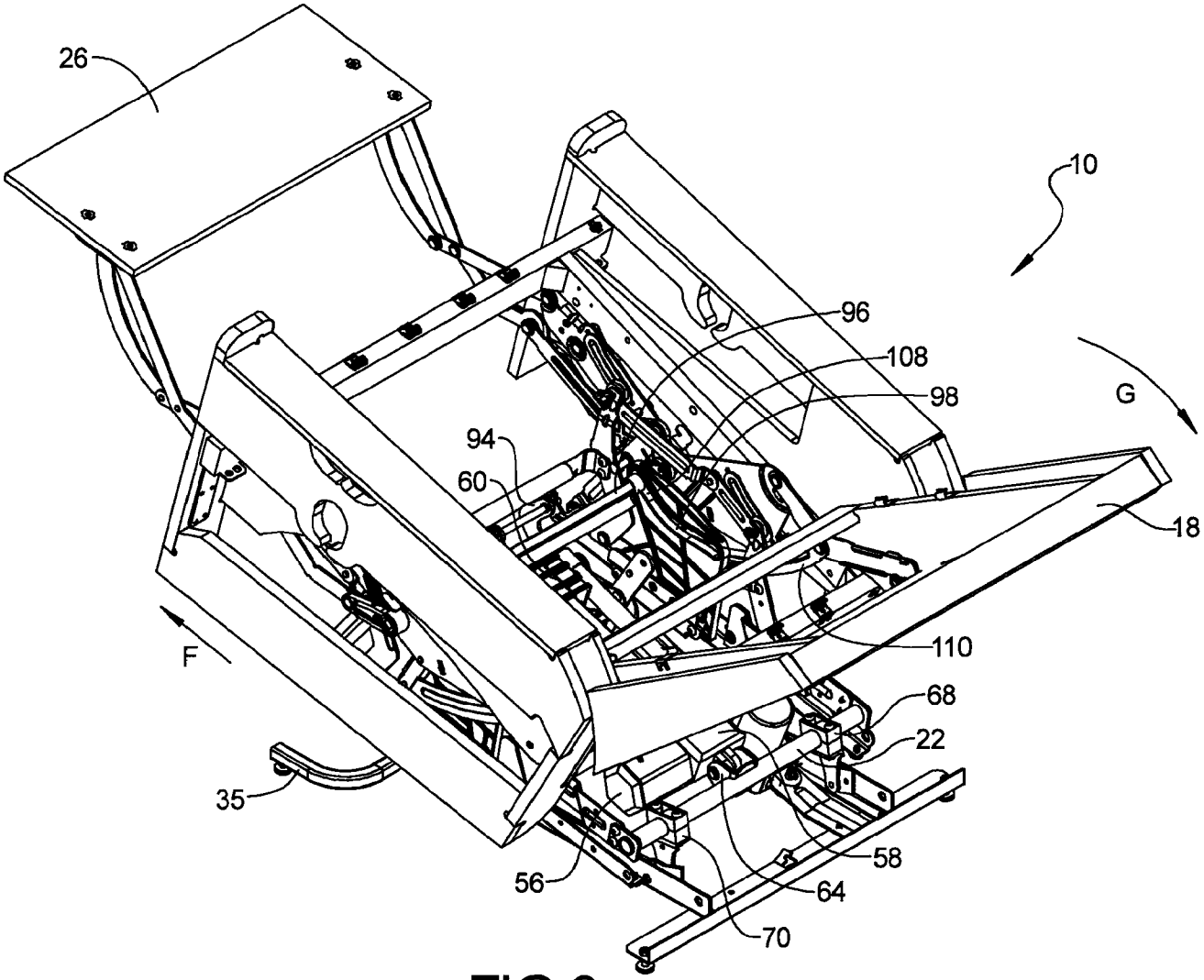
FIG. 9 is a rear perspective view looking forward of the furniture member rear tilt and leg rest fully extended position of FIG. 6, further showing a seat back fully reclined position.

Referring to FIG. 9 and again to FIGS. 6-8, if the occupant continues to operate the second motor 56 after leg rest member 26 reaches its fully extended position, continued forward sliding displacement of slide assembly 60 causes displacement of the rotational bracket assembly 94, thereby further forwardly displacing the drive rod 96 until drive rod 96 reaches a forward slot end 108 of V-shaped slot 98. During the continued forward translation of drive rod 96 within the V-shaped slot 98, the forward displacement of drive rod 96 causes a rearward rotation of the seat back member 18 with respect to a seat back recline direction "G". Seat back member 18 recline is directed by displacement of an arc link 110, 110' positioned on opposite right and left hand sides of furniture member 10. Rearward rotation of the seat back member 18 to a fully reclined positioned (shown) is achieved when the drive rod 96 contacts the forward slot end 108. Some rotation of the first and second journal bearings 68, 70 also occurs during the displacement of leg rest member 26, which is permitted by the rotational connection between drive housing 58 and pivot tube 22 using the pivot mount 64. Additional rotation of each of the first and second journal bearings 68, 70 also occurs during the rotation of seat back member 18.

Figure 10:
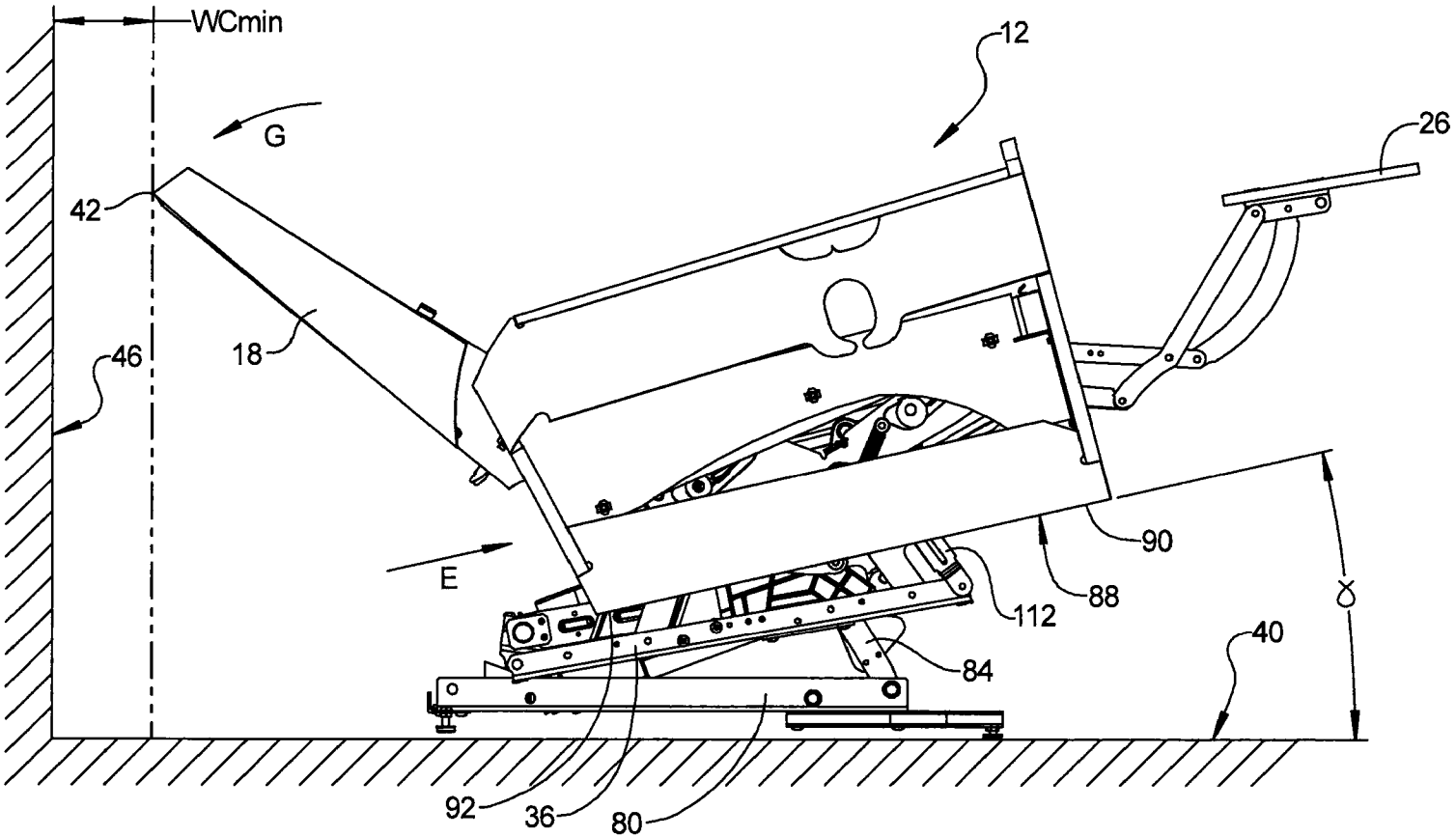
FIG. 10 is a right side elevational view of the furniture member of FIG. 9.

Referring to FIG. 10 and again to FIGS. 1-9, the rearward rotation of seat back member 18 to its fully reclined position shown, by rotation with respect to the seat back recline direction "G", positions rearmost point 42 of seat back member 18 at its closest point of approach to wall surface 46, defined as wall clearance WC minimum with respect to wall surface 46. WC minimum is predetermined to provide sufficient clearance for upholstery which is commonly provided on seat back member 18 such that the upholstery also does not contact wall surface 46 at the fully reclined position of seat back member 18. As the seat back member 18 reclines, additional displacement of base member 12 occurs in the forward elevation/extension direction "E". This additional forward extension causes rotation of a second rotation link 112 (a left hand second rotation link 112' is not clearly visible in this view). Second rotation link 112 is rotatably connected to the first L-shaped frame member 80. Due to the forward rotation of second rotation link 112, the base member lower surface 88 is additionally elevated and angled at a third tilt angle $\gamma$ (gamma) with respect to the floor surface 40 when seat back member 18 reaches the fully reclined position. According to several aspects, third tilt angle $\gamma$ (gamma) is greater than each of angle $\beta$ (beta) and angle $\alpha$ (alpha) previously described herein. It is further noted that the base member lower rear corner 92, as well as the base member lower front corner 90, are both additionally elevated with respect to the seat back fully extended position and/or the tilt position of base member 12, previously described herein.

Figure 11:
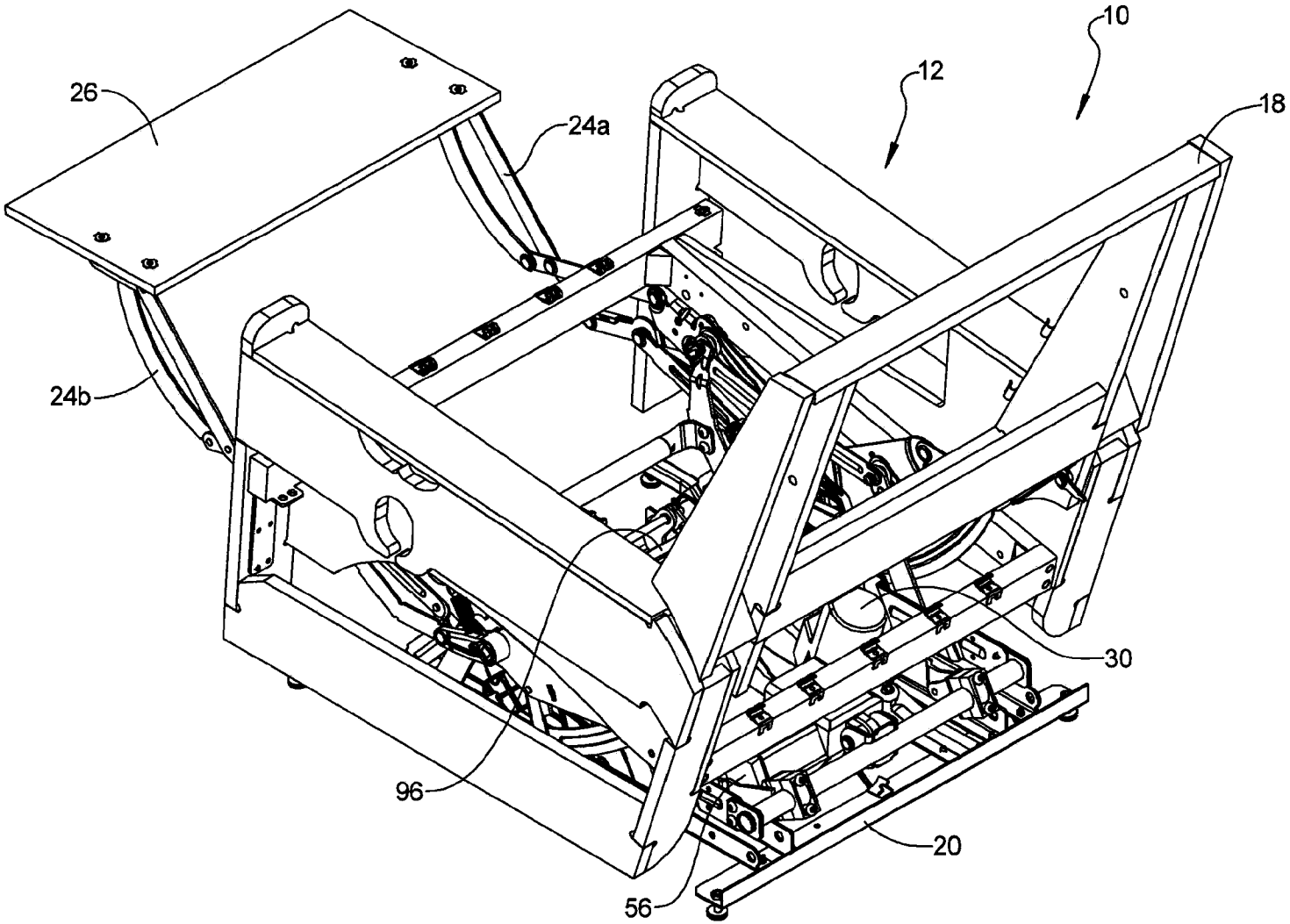
FIG. 11 is a rear perspective view looking forward of the furniture member of FIG. 1, further showing a leg rest fully extended position.

Referring to FIG. 11 and again to FIG. 1, prior to achieving any tilt position of base member 12 with respect to base frame 20, the leg rest member 26 can be extended from its stowed position to the fully extended position, shown by operation of second motor 56 alone, and therefore without operation of first motor 30. With the base member 12 in its fully upright position, operation of second motor 56, as previously described, will cause forward displacement of the drive rod 96, thereby extending both of the leg rest linkage assemblies 24*a*, 24*b*. The occupant can therefore select full extension of leg rest member 26 without requiring any tilt position of base member 12.

Referring to FIG. 12 and again to FIGS. 1-4, by modifying first mechanism 47, furniture member 10 can separately be operated as a lift chair. In a lift mode of operation, actuation of first motor 30 causes a forward rotation of base member 12 in a lift rotation direction "H" in lieu of providing the rearward tilt motion previously described. The first and second rotation links 84, 84' are individually rotatably connected to the first and second L-shaped frame members 80, 82 using first and second rotational fasteners 114, 114' (only second rotational fastener 114' is clearly visible in this view). In lift chair mode, the base member 12 rotates with respect to an axis of rotation 116 defined through the central axes of first and second rotational fasteners 114, 114'. The lift chair mode thereby provides lifting support to help the occupant reach a near standing position to exit furniture member 10. During operation in lift chair mode, the leg rest linkage assembly 24 is prevented from extending away from the stowed position by preventing operation of second motor 56 by lockout programming provided in controller 33. The first and second link connecting plates 76, 78, together with the first and second rotation links 84, 84', provide rotational support for base member 12. The first and second link connecting plates 76, 78 are connected at rear ends to the first and second journal bearings 68, 70, and at forward ends using third and fourth rotational fasteners 118, 118' (only fourth rotational fastener 118' is visible in this view), which rotatably connect to each of the first and second L-shaped frame members 80, 82 at positions rearward of the first and second rotational fasteners 114, 114'.

Figure 12:
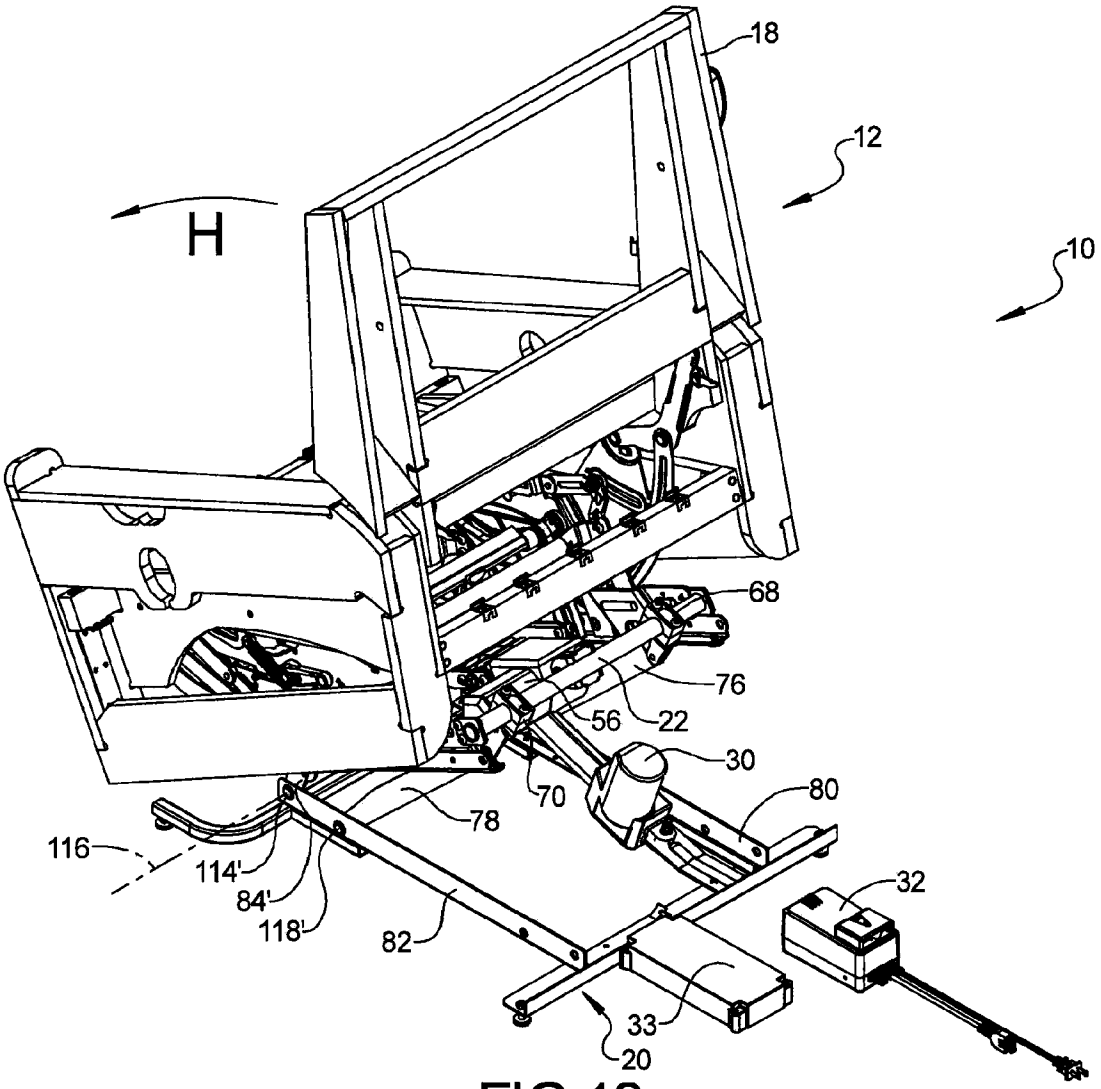
FIG. 12 is a rear perspective view looking forward of the furniture member of FIG. 1, further showing a full forward lift position.
Figure 13:
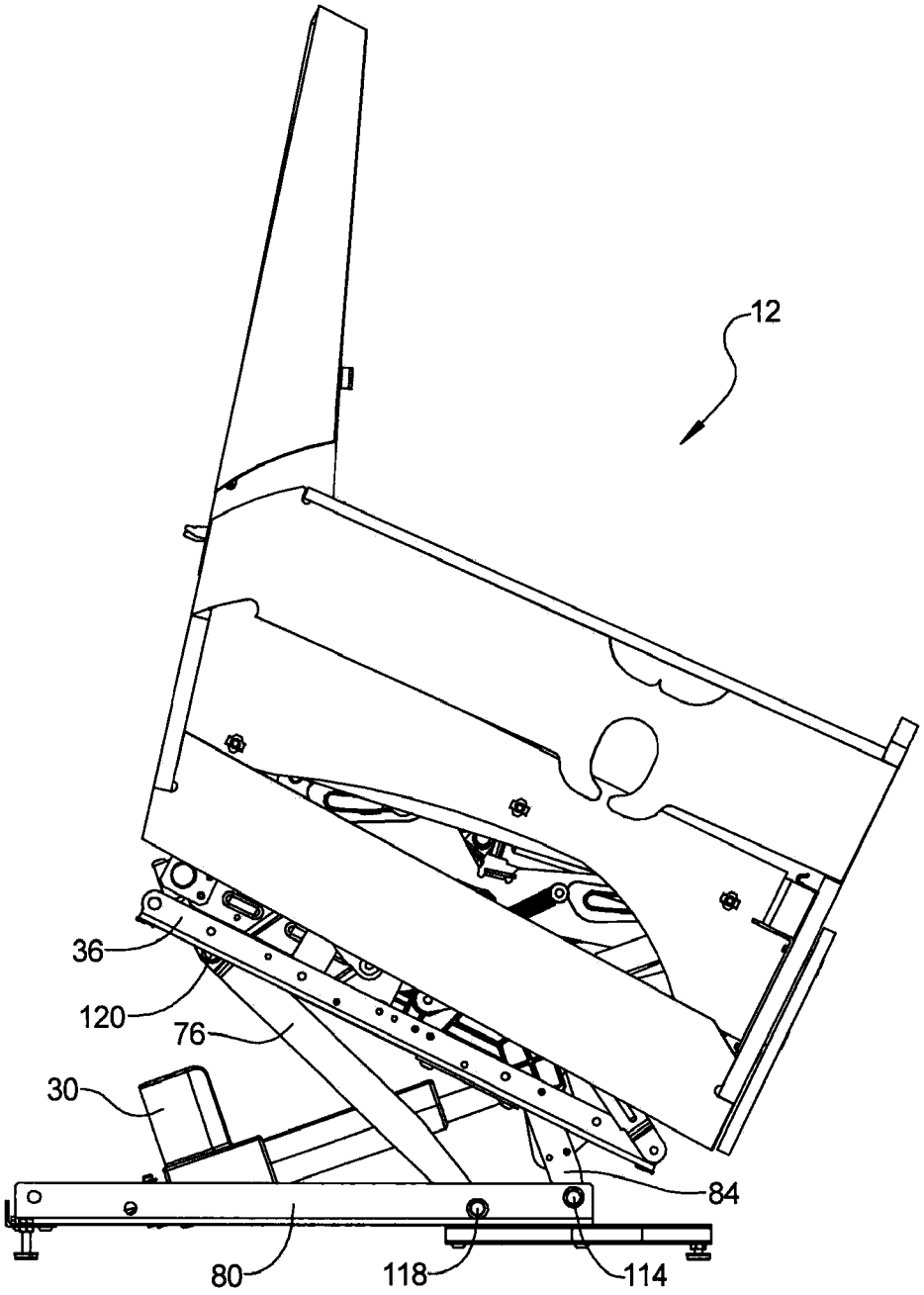
FIG. 13 is a right side elevational view of the furniture member of FIG. 12.

Referring to FIG. 13 and again to FIG. 12, at the lift position of furniture member 10, the side frame members 36, 36' (only side frame member 36 is visible in this view) are oppositely oriented than the orientation during chair tilt. A rear axis of rotation 120 is defined where the first and second link connecting plates 76, 78 are rotatably connected to the side frame members 36, 36'.

Figure 14:
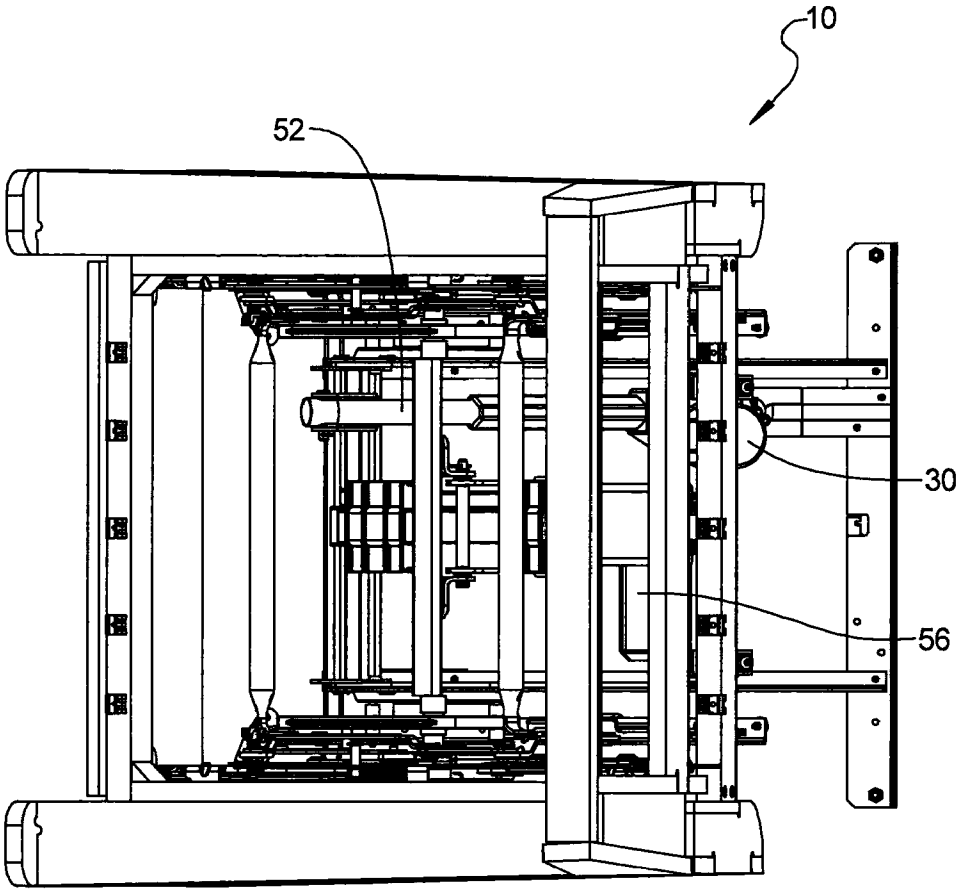
FIG. 14 is a top plan view of the furniture member of FIG. 12.

Referring to FIG. 14, during lift operating mode, operation of first motor 30 stops when full forward displacement of extension shaft 52 is reached. As previously noted, second motor 56 is prevented from operation during lift operating mode.

Referring to FIG. 15 and again to FIG. 4, first mechanism 47 is shown following operation of first motor 30 to achieve the rear tilt position described with reference to FIG. 4. During operation of first motor 30, as the extension shaft 52 axially extends from shaft housing 50, the coupling bracket 66 is induced to rotate forwardly, thereby displacing first and second torque tubes 122, 124 which are coupled to the first rotation links 84, 84'. First and second mount brackets are connected to the first rotation links 84, 84' and define an extent of the first mechanism 47, such that first mechanism 47 creates a first support portion of furniture member 10. Forward rotation of the first rotation links 84, 84' causes each of the first and second journal bearings 68, 70 to also forwardly rotate. Because the length of first rotation links 84, 84' is greater than a length of the first and second journal links 72, 74, the first and second torque tubes 122, 124 elevate to a greater degree than the pivot tube 22. The rotation of first and second journal links 72, 74 during tilt rotation mode is provided by use of a journal rotational fastener connecting each to its respective first or second link connecting plates 76, 78.

Figure 15:
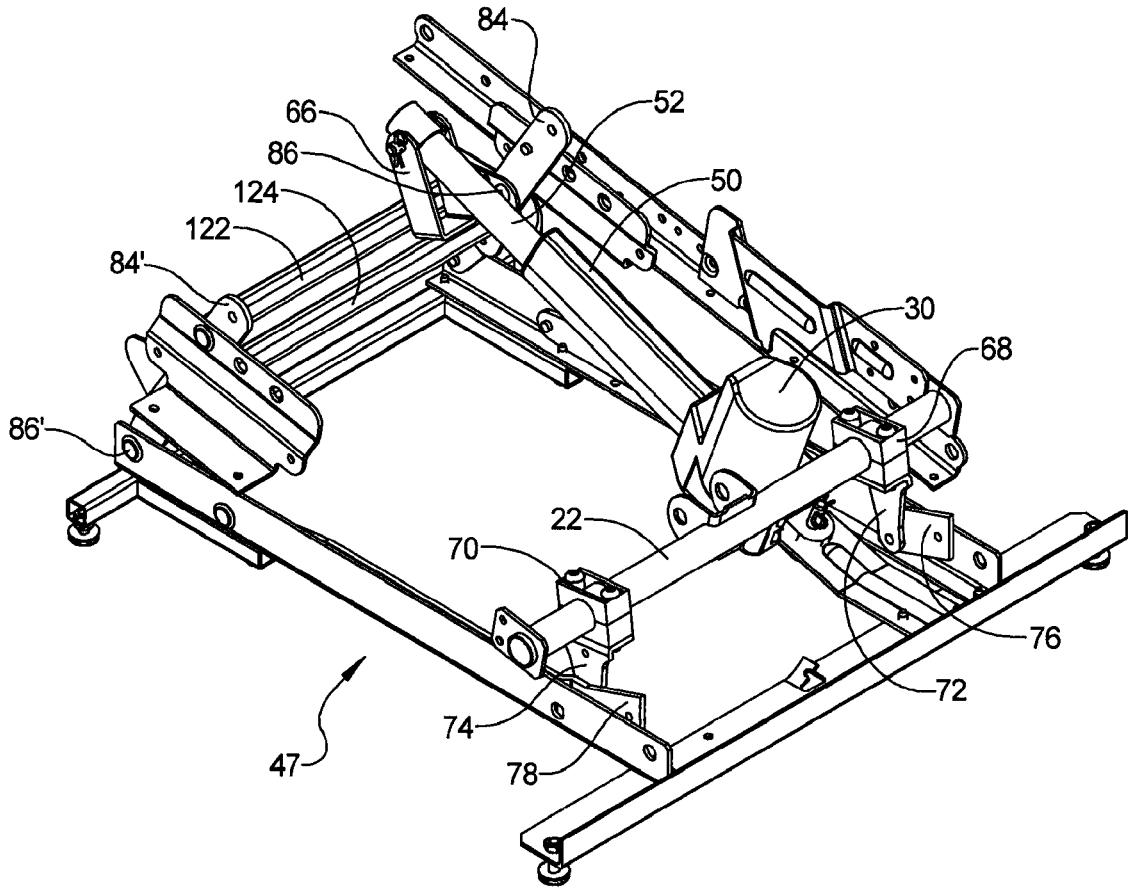
FIG. 15 is a rear perspective view looking forward of the mechanism assembly at the furniture member position of FIG. 4.
Figure 16:
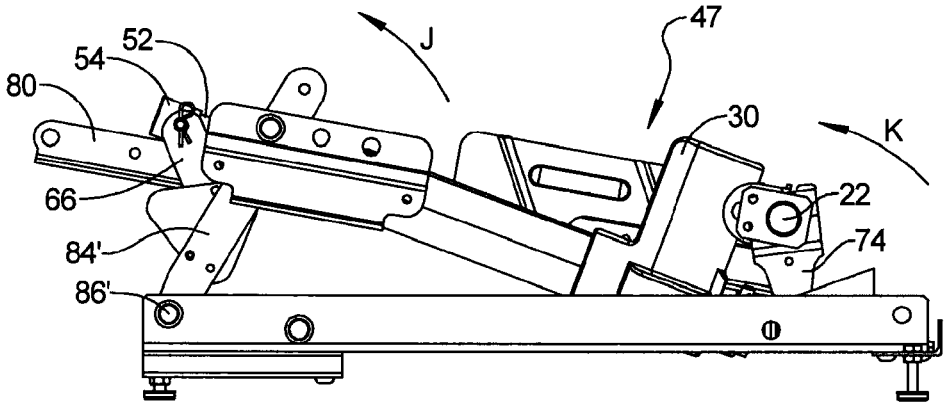
FIG. 16 is a left side elevational view of the mechanism assembly of FIG. 15.

Referring to FIG. 16 and again to FIGS. 4 and 15, as previously described, the outward extension of extension shaft 52 causes forward rotation of first rotation links 84, 84' with respect to first rotational fasteners 86, 86', causing the first rotation links 84, 84' to rotate with respect to a link arc of rotation "J". Similarly, each of the first and second journal links 72, 74 (only second journal link 74 is clearly visible in this view) rotate with respect to a journal arc of rotation "K", which according to several aspects has an arc length shorter than a length of the arc length of link arc of rotation "J". The first rotation links 84, 84' are longer than the first and second journal links 72, 74, which provides the rear tilt position having the pivot tube 22 positioned below the first and second torque tubes 122, 124.

Referring to FIG. 17 and again to FIGS. 1-3 and 15-16, the forward lift position of first mechanism is shown. As previously noted, components of first mechanism 47 include first motor 30, drive housing 48, shaft housing 50, extension shaft 52, and coupling end 54. The components of first mechanism 47 are connected to a rear frame member 121 of base frame 20 at a rear end (to the right as viewed in FIG. 17) of the furniture member 10 and also to each of the first and second torque tube 122, 124 at a forward end of furniture member 10. According to several aspects, the first and second torque tubes 122, 124 are fixed to each other as well as to oppositely disposed tube attachment plates 126, 126'. According to further aspects, the first and second torque tubes 122, 124 can be replaced by a single torque tube. The tube attachment plates 126, 126' are, in turn, connected to each of the first rotation links 84, 84'. As previously noted, the first rotation links 84, 84' are each rotatably connected using first rotational fasteners 86, 86' to individual ones of the first and second L-shaped frame members 80, 82. The coupling bracket 66 is fixed to the first and second torque tubes 122, 124 such that axial displacement of extension shaft 52 forwardly and upwardly displaces each of the first torque tube 122, the second torque tube 124, and the tube attachment plates 126, 126'. This displacement causes forward rotation of each of the first rotation links 84, 84' with respect to the axis 116 defined by first rotational fasteners 86, 86'.

A rear end of the drive housing 48 is connected, using a clevis and clevis pin assembly 128, to a motor mount plate 129. Motor mount plate 129 is, in turn, fixed to the rear frame member 121. Use of clevis and clevis pin assembly 128 therefore allows the drive housing 48 to rotate during axial extension or return of extension shaft 52. A first support bracket 130, 130' is rotatably connected to the first rotation links 84, 84' by rotational fasteners 132, 132'. Each of the first support brackets 130, 130' connects to and supports either a first or second support frame 136, 136' (only first support frame 136 is shown for clarity). Each of the first and second support frames 136, 136' is connected to pivot tube 22 and to one of the first or second L-shaped frame members 80, 82.

Figure 20:
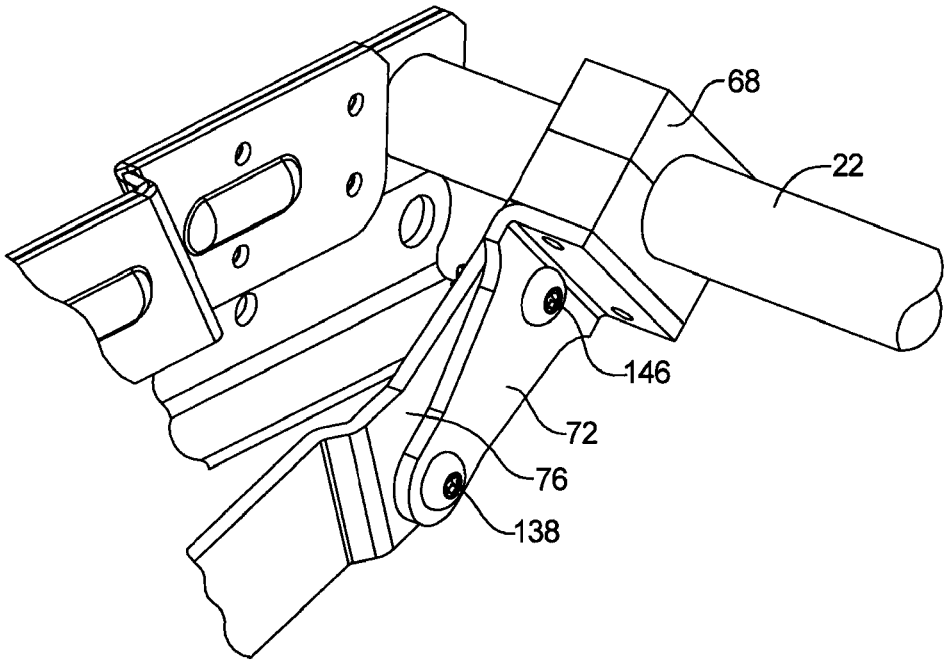
FIG. 20 is the left side perspective view looking rearward of FIG. 19 modified to show installation of a further fastener.

A first fastener 138, 140, if used alone, rotatably connects the first and second journal links 72, 74 to one of the first and second link connecting plates 76, 78 and thereby allows rear tilt mode operation. As will be better described in reference to FIG. 20, a second fastener fixedly connecting the first and second journal links 72, 74 to the first and second link connecting plates 76, 78, when used in conjunction with fasteners 138, 140, prevents rotation of the first and second journal links 72, 74 with respect to the first and second link connecting plates 76, 78, thereby providing for lift mode operation of furniture member 10. A forward lift position (shown) has the pivot tube 22 positioned above the torque tube 122, 124. To provide additional structural support for furniture member 10 for operation in lift mode, the extended support legs 35, 35' can be augmented using first and second support tubes 142, 142' fixed to the extended support legs 35, 35' and also each fixed to one of the first or second L-shaped frame members 80, 82.

Figure 17:
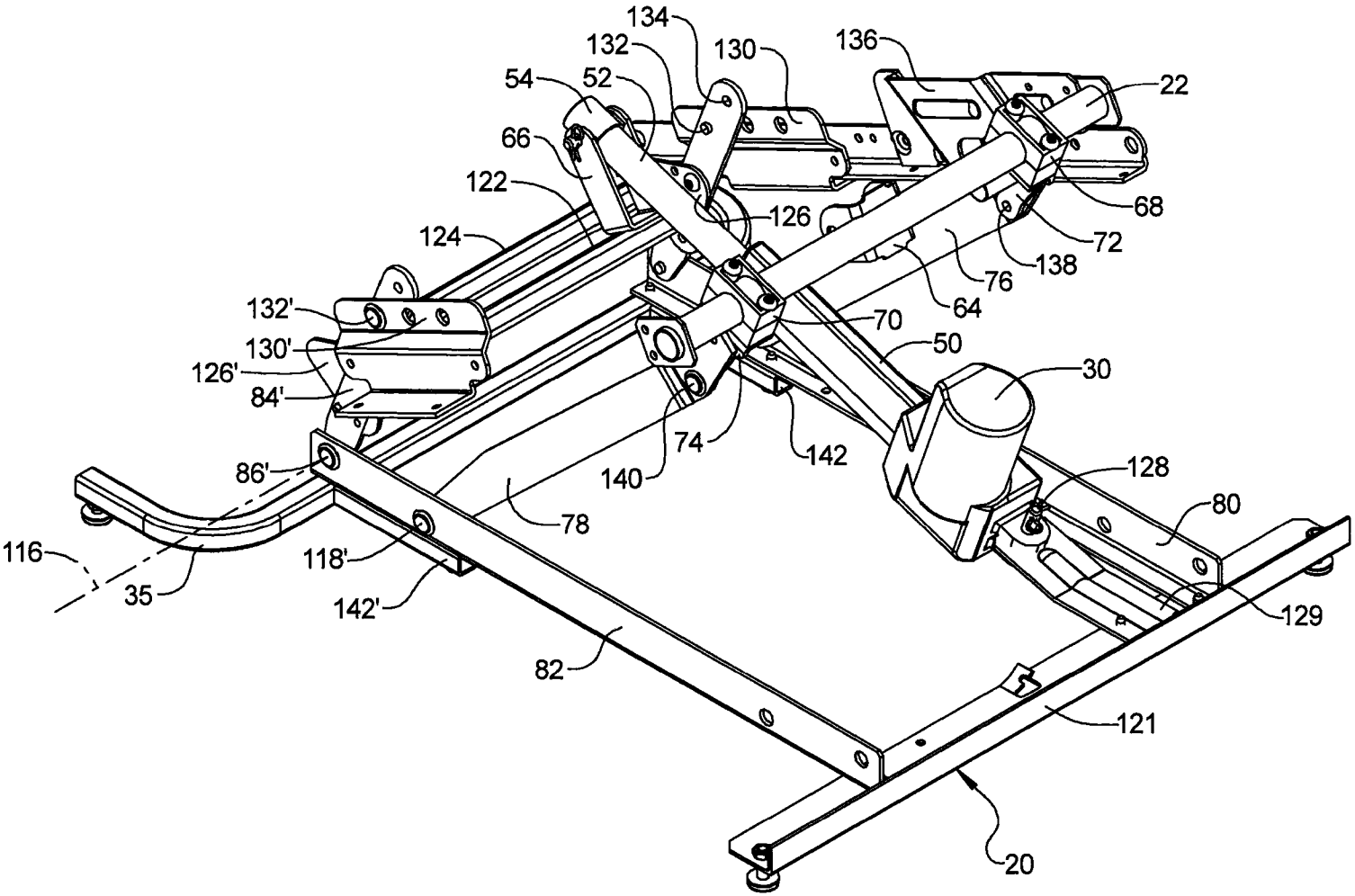
FIG. 17 is a rear perspective view looking forward of a mechanism in the full forward lift position, similar to FIG. 12.

Referring to FIG. 18 and again to FIG. 17, the first rotation links 84, 84' are shorter than the first and second link connecting plates 76, 78. Rotation of the first rotation links 84, 84', with respect to common longitudinal axes extending through the first rotational fasteners 86, 86', defines an arc of rotation "J". Rotation of the first and second link connecting plates 76, 78, with respect to common longitudinal axes extending through the third and fourth rotational fasteners 118, 118', defines an arc of rotation "K" having a radial length which is greater than the radial length of arc of rotation "J", thereby providing lift rotation and a lift mode from the same axial extension of extension shaft 52 previously used to provide tilt rotation in the tilt mode.

Figure 18:
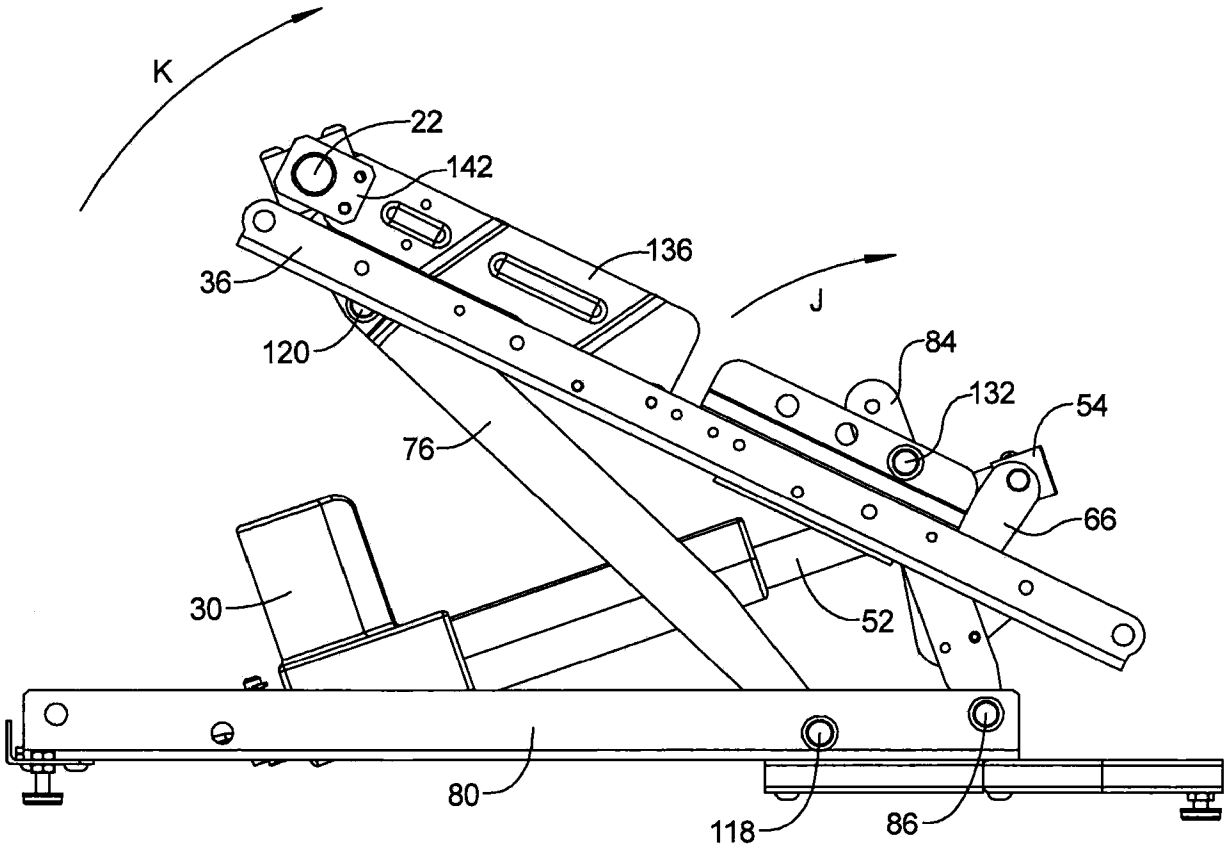
FIG. 18 is a right side elevational view of the mechanism of FIG. 17.

Referring to FIG. 19 and again to FIGS. 17-18, the following discussion of first journal link 72 applies equally to second journal link 74 (not shown in this view). When fastener 138 alone is received in an aperture 144 of first journal link 72 and extends through first link connecting plate 76, fastener 138 permits first journal link 72 to rotate with respect to first link connecting plate 76. This permits first journal bearing 68 and pivot tube 22 to rotate, thereby permitting tilt rotation of furniture member 10 as described in reference to FIGS. 4-5.

Figure 19:
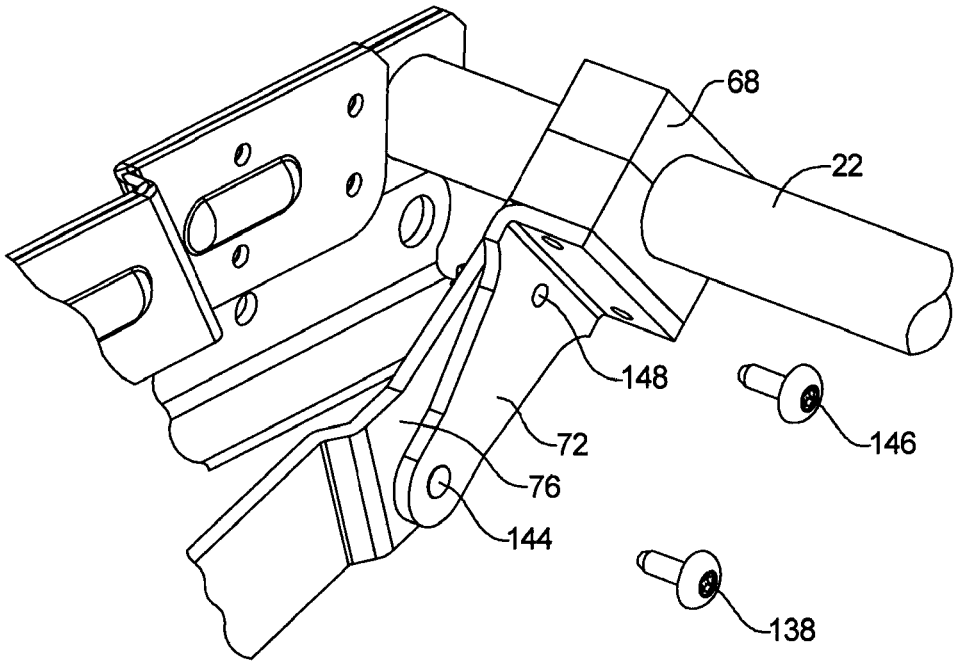
FIG. 19 is a left side perspective view looking rearward of area 19 of FIG. 1.

Referring to FIG. 20 and again to FIGS. 17-19, the following discussion of first journal link 72 applies equally to second journal link 74 (not shown in this view). Fastener 138 is received in aperture 144 of first journal link 72 and extends through first link connecting plate 76. A second fastener 146 is received in an aperture 148 of first journal link 72 and extends through first link connecting plate 76. First and second fasteners 138, 146 together prohibit rotation of first journal link 72 with respect to first link connecting plate 76. This prohibits first journal bearing 68 and pivot tube 22 from axial rotation with respect to first link connecting plate 76, thereby producing lift motion of furniture member 10 as described in reference to FIGS. 12-14. The addition or omission of second fastener 146 is therefore all that is necessary to change first mechanism 47 of furniture member 10 from a tilt mode mechanism to a lift mode mechanism or vice versa.

Referring to FIG. 21 and again to FIGS. 1-20, a furniture member 150 is similar to furniture member 10; therefore, only the differences will be further discussed. Furniture member 150 is depicted as a rocking reclining chair and includes a base member 152, which is similar to base member 12, and a left side armrest member 154 (a similar but opposite right side armrest member is not visible in this view). A seat back member 156 is rotatably disposed with respect to the base member 152. A leg rest assembly 158 is extensible and retractable with respect to base member 152 and is shown in a fully retracted position. The base member 152, the seat back member 156, and the leg rest assembly 158 are supported on a base frame 160 which can be made, for example, from rectangular metal tubing fixed, such as by welding or fasteners, to each other. The base member 152 is rotatable with respect to base frame 160, and can further both tilt and be forwardly displaced in similar motions as described with respect to furniture member 10.

Opposed first and second side frame members 162, 163 (only side frame member 162 is visible in this view) are similar to opposed side frame members 36, 36' and support a mechanism 164 for displacement with respect to the base frame 160. Mechanism 164 provides for operation and motion of leg rest assembly 158, rotation and motion of the base member 152, as well as rotation of seat back member 156. To further stiffen side frame members 162, 163, a stiffening tube assembly 165 mounts directly beneath side frame members 162, 163. Stiffening tube assembly 165 will be described in greater detail in reference to FIG. 27. In a furniture member normal or upright position with the leg rest assembly 158 retracted, a front lower corner 166 of the left side armrest member 154 is positioned at an elevation lower than an elevation of a rear lower corner 168 of the left side armrest member 154.

Figure 24:
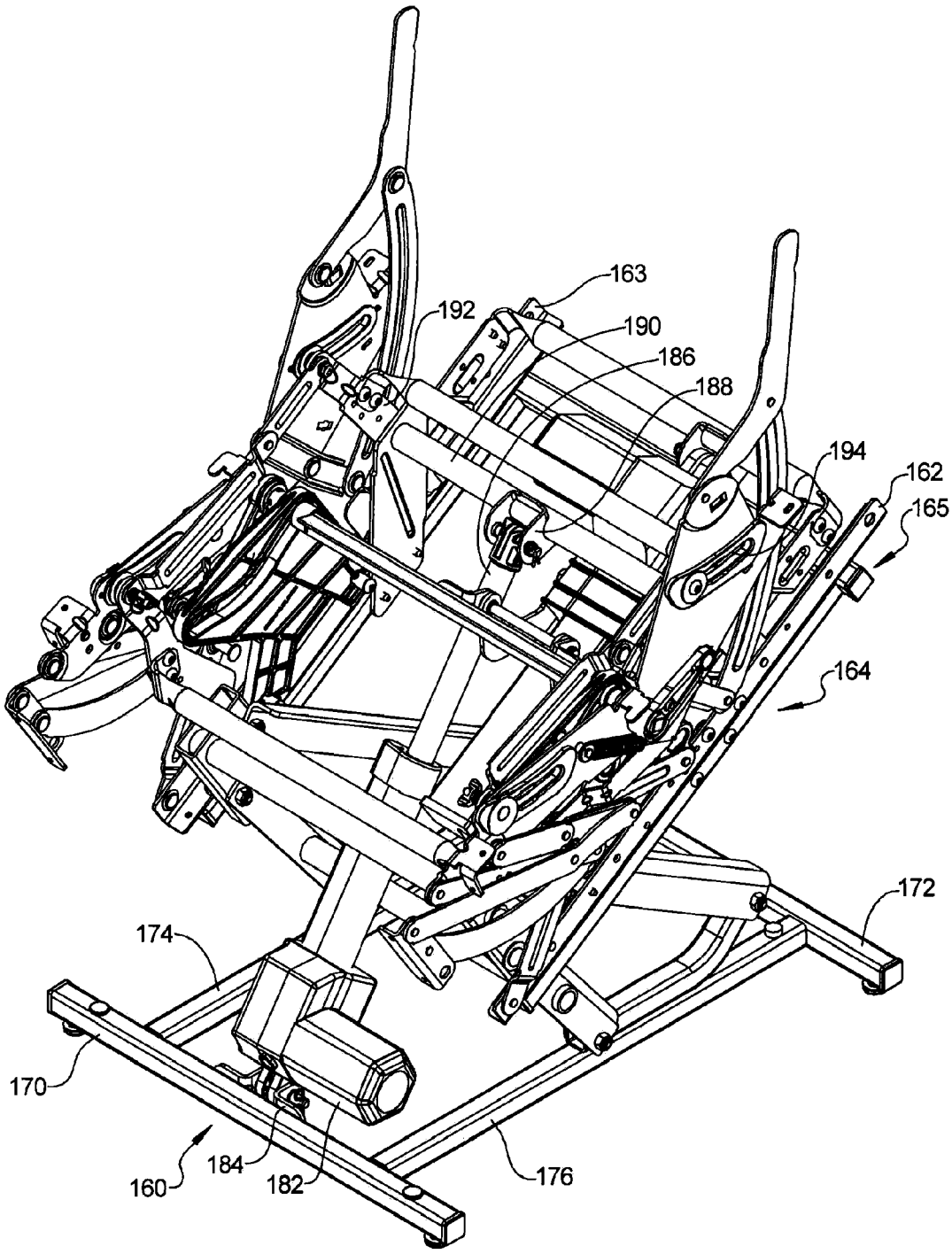
FIG. 24 is a front left perspective view of the mechanism of FIG. 22 with the furniture member framing removed for clarity.

Referring to FIG. 22 and again to FIGS. 1-4, 12, and 21, furniture member 150 can be operated as a lift chair. In a lift mode of operation, actuation of a motor (shown and described in reference to FIG. 24) causes a forward rotation of base member 152 in a lift rotation direction "L", which is similar to lift rotation direction "H" previously described in reference to furniture member 10. The base frame 160 provides rectangular shaped tubular first and second frame members 170, 172 acting as front and rear support members, which are parallel to each other. Rectangular shaped tubular third and fourth frame members 174, 176 are fixed to and transversely oriented with respect to first and second frame members 170, 172 and are oriented parallel to the armrest members of furniture member 150. Similar to furniture member 10, the lift chair mode provides lifting support to help an occupant reach a near standing position to exit furniture member 150. Unlike base member 12, in lift chair mode, base member 152 does not rotate with respect to a unitary axis of rotation due to a different configuration of support links used. Similar to furniture member 10, during operation in lift chair mode, the leg rest assembly 158 is prevented from extending away from the stowed position.

Figure 21:
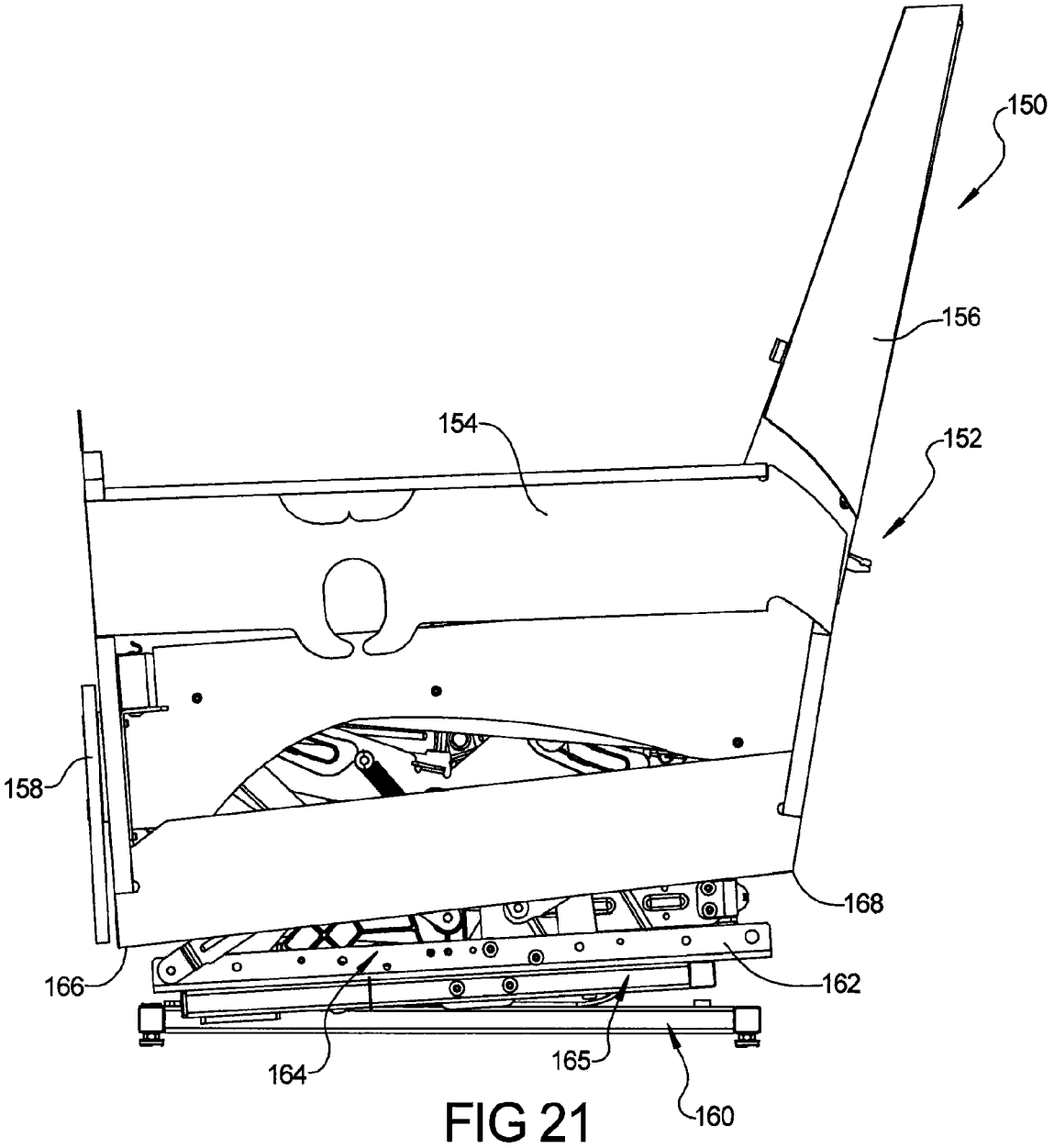
FIG. 21 is a left side elevational view of a furniture member having a mechanism modified from the mechanism of FIGS. 1-20.
Figure 22:
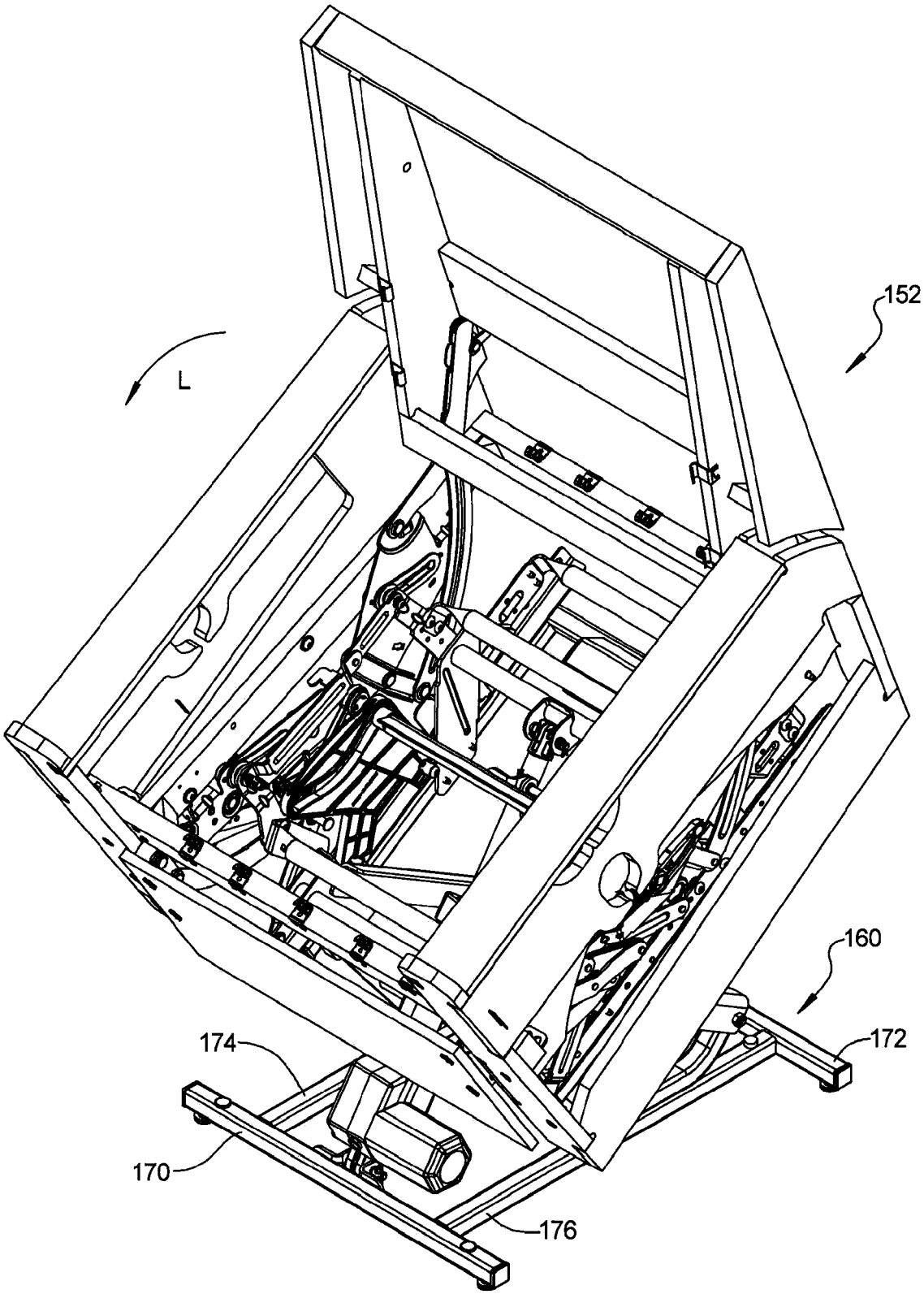
FIG. 22 is a front left perspective view of the furniture member of FIG. 21 shown after movement to a full forward lift position.
Figure 23:
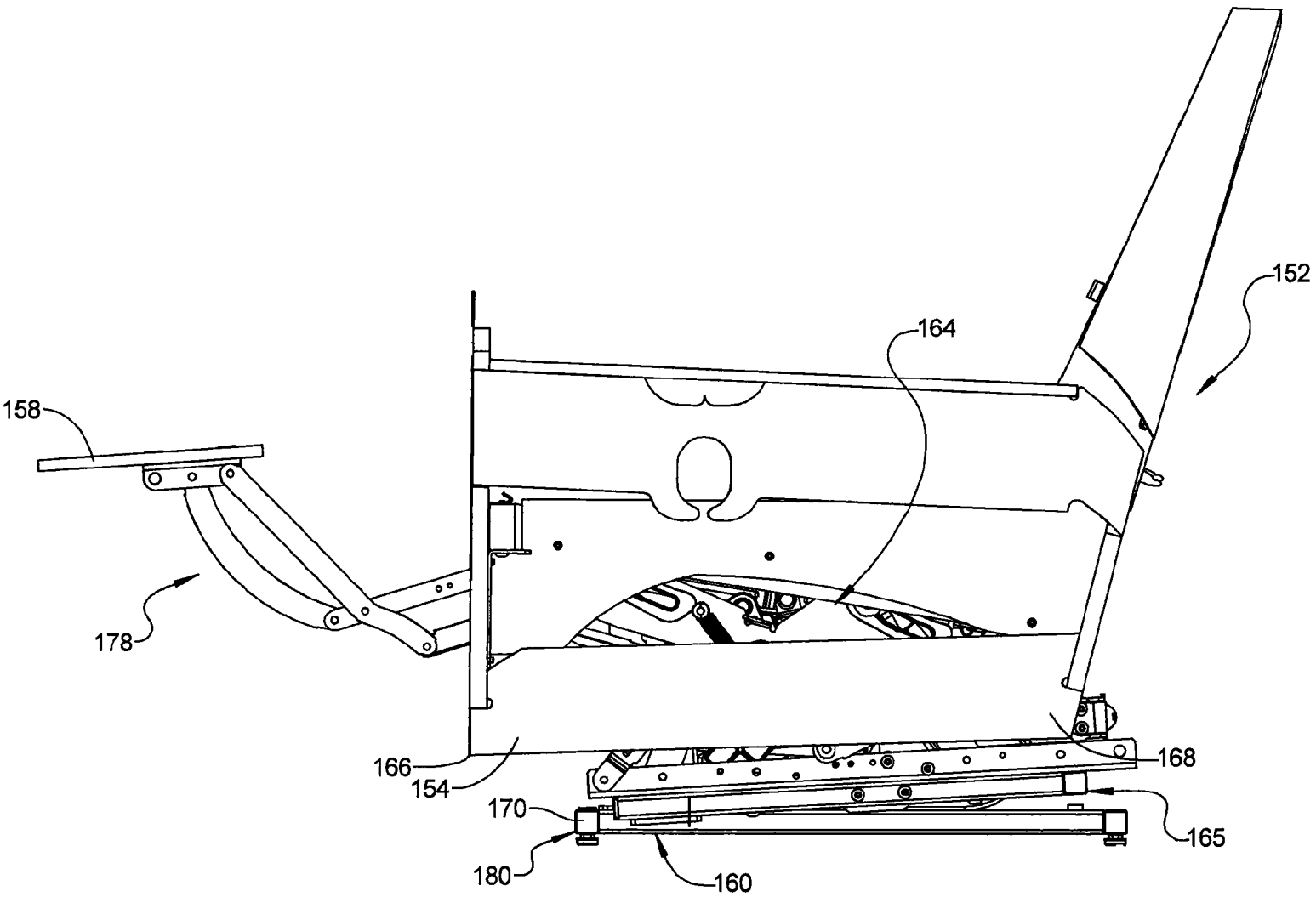
FIG. 23 is a left side elevational view of the furniture member of FIG. 21 with the leg rest assembly in a fully extended position.

Referring to FIG. 23 and again to FIGS. 21-22, the leg rest assembly 158 is shown in the fully extended position. Leg rest assembly 158 is operated by a separate motor similar to second motor 56, previously described in reference to FIG. 6. In the leg rest fully extended position, the base member 152 rotates rearwardly with respect to the upright position of base member 152. This repositions the front lower corner 166 of the left side armrest member 154 to an elevation higher than the elevation of the front lower corner 166 at the upright position shown in FIG. 21. The leg rest assembly 158 is supported by a pantograph linkage set 178. During extension of the leg rest assembly 158 and pantograph linkage set 178, the base member 152 also displaces forward with respect to base frame 160, such that the front lower corner 166 of the left side armrest member 154 moves forward with respect to a front end face 180 of the first frame member 170 of base frame 160. A rear tilt position of the base member 152 is thereby provided, which can be reached with the leg rest assembly 158 in the fully extended position shown.

Referring to FIG. 24 and again to FIGS. 21-23 and FIGS. 12-17, a motor 182 functions similar to first motor 30 to move the base member 152 to the fully forward lift position. Unlike first motor 30, however, which is connected using motor mount plate 129 to rear frame member 121, motor 182 is rotatably mounted to a motor mount bracket 184, which is fixed to first frame member 170. An extension shaft 186, which operates similar to extension shaft 52, extends outwardly during operation of motor 182. Extension shaft 186 is rotatably connected to a coupling bracket 188, which is similar to coupling bracket 66. Coupling bracket 188 is fixed to a single torque tube 190, which is positioned at a rear position of furniture mechanism 164 and used in place of the forward positioned double torque tubes 122, 124. Torque tube 190 is connected at opposite ends to each of a first and second support bracket 192, 194 which are fixed to members of stiffening tube assembly 165, as will be better described in reference to FIG. 27.

Figure 27:
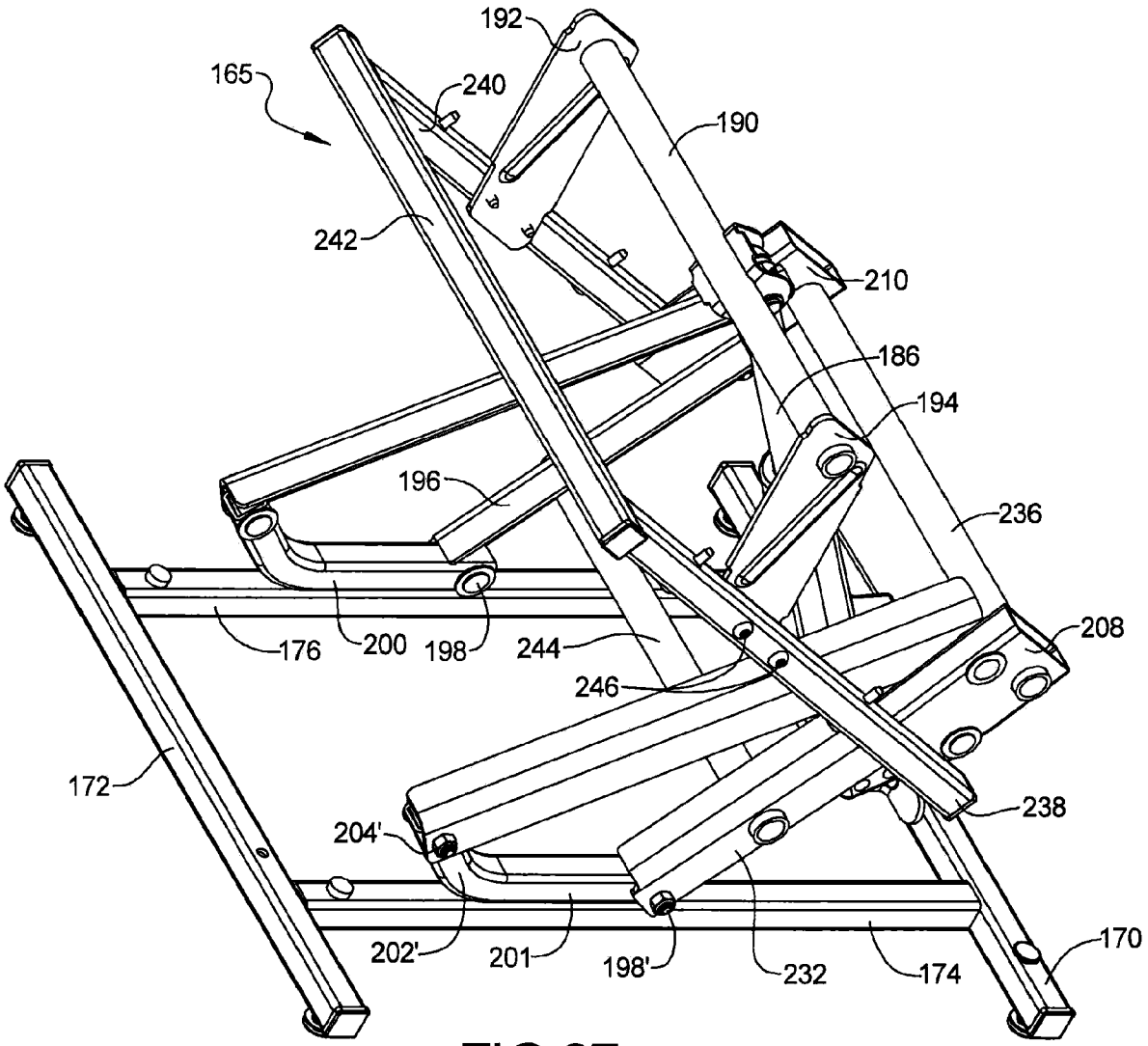
FIG. 27 is a right rear perspective view of the mechanism portion of FIG. 26 after movement to the full forward lift position.

Referring to FIG. 25 and again to FIGS. 21-24 and FIGS. 12-17, the linkage set used for displacement of base member 152 is modified from the linkage set of furniture member 10. A first rotation link 196 is longer than first rotation link 84. First rotation link 196 is rotatably connected using a rotational fastener 198 to a forward end of a first frame support tube 200 (a second frame support tube 201, not visible in this view, described in greater detail in reference to FIG. 27 is a mirror image of first frame support tube 200). A first or forward end of first frame support tube 200 is positioned proximate to a center or mid-span of fourth frame member 176; therefore, rotational fastener 198 is also positioned approximately mid-span in the front-to-back alignment of fourth frame member 176 in lieu of the forward locations of first and second rotational fasteners 114, 114'. This mid-span location of rotational fastener 198, together with the extended length of first rotation link 196, allows the side frame members 162, 163 to lift at their forward ends to a forward clearance or lift height "M", which is greater than the corresponding lift provided with side frame members 36, 36'.

Figure 25:
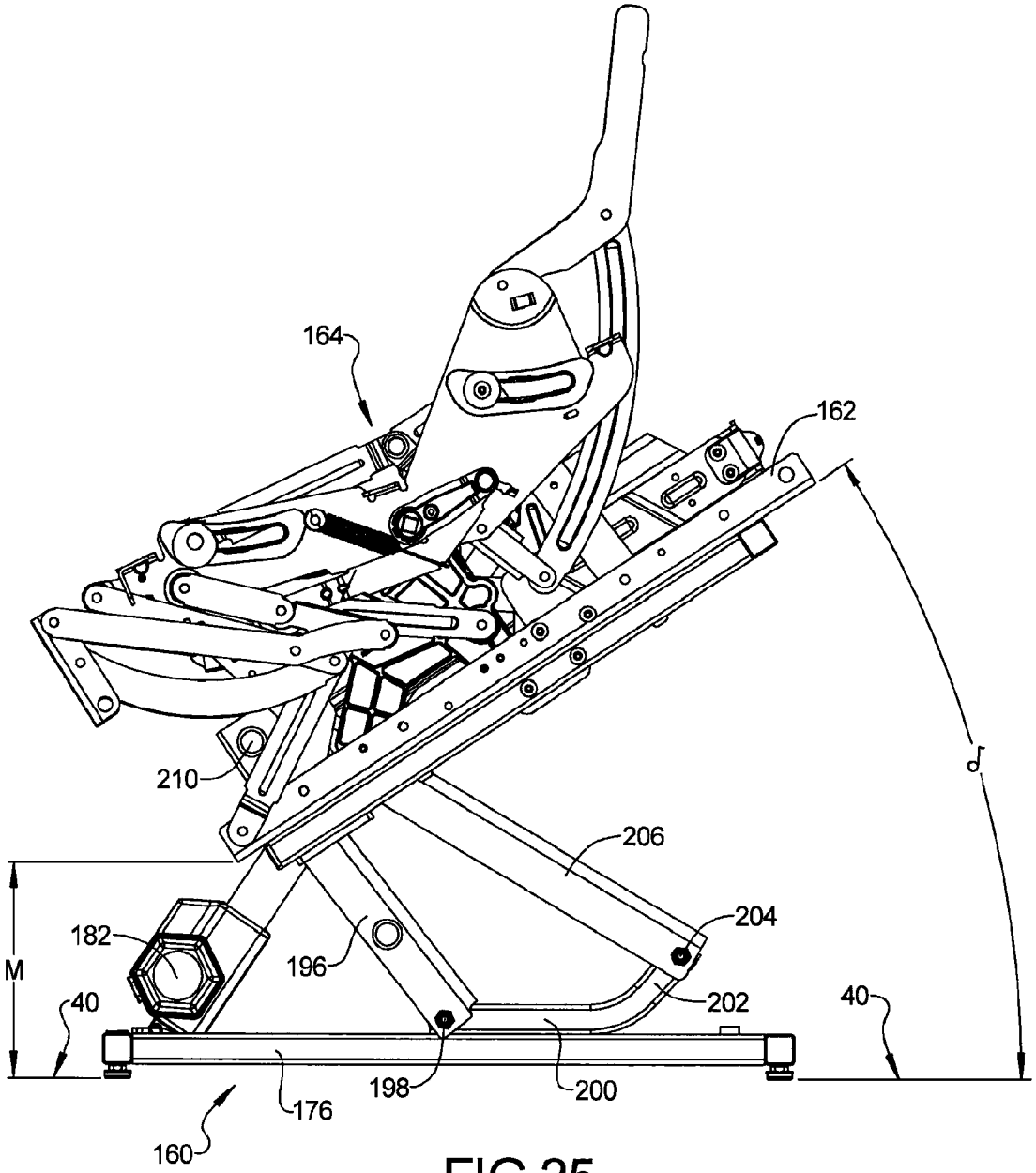
FIG. 25 is a left side elevational view of the mechanism of FIG. 24.

With continuing reference to FIG. 25, first frame support tube 200 includes an upward directed bend 202 at a furniture member rear facing end which elevates the position of a second rotational fastener 204 above rotational fastener 198. Second rotational fastener 204 is rotationally connected to a rear facing end of the first frame support tube 200; therefore, first and second rotational fasteners 198, 204 are connected at opposite ends of the first frame support tube 200 with second rotational fastener 204 elevated above first rotational fastener 198. A second rotation link 206 is rotatably connected to first frame support tube 200 at upward directed bend 202 using second rotational fastener 204, thereby positioning the second rotational fastener 204 higher in elevation with respect to the floor surface 40 than the first rotational fastener 198. Rotational fastener 204 is thereby also positioned rearward of rotational fastener 198. Both first and second rotation links 196, 206 are rotatably connected to a rectangular shaped tube member 210 (a right side tube member 208 is not visible in this view) connected to structure of stiffening tube assembly 165, as will be better described in reference to FIG. 26. The first and second rotation links 196, 206 together define a first set of rotation links.

At the furniture member full forward lift position (shown), the side frame members 162, 163 are both oriented at an angle delta (δ) of approximately 30 degrees with respect to floor surface 40. As previously noted, base member 152 does not rotate with respect to a unitary axis of rotation because of the configuration of rotation links 196, 206 used, which is a result of the difference in both location of and height between first and second rotational fasteners 198, 204 and the connection locations of the first and second rotation links 196, 206 to the second support bracket 194. The forward clearance or lift height "M", between a forward end of each of the side frame members 162, 163 in the configuration of furniture member 150, is greater than a similar forward lift height "N" (shown in FIG. 18) for the mechanism of furniture member 10, due to the mid-span location of rotational fastener 198 and the bend 202 of first and second frame support tubes 200, 201. These features together allow the lift height "M" and the lift angle δ to be increased compared to the limitation of having the first rotational fasteners 86, 86' located at a forward end of the first and second L-shaped frame members 80, 82 which limits an axis of rotation of furniture member 10.

Figure 26:
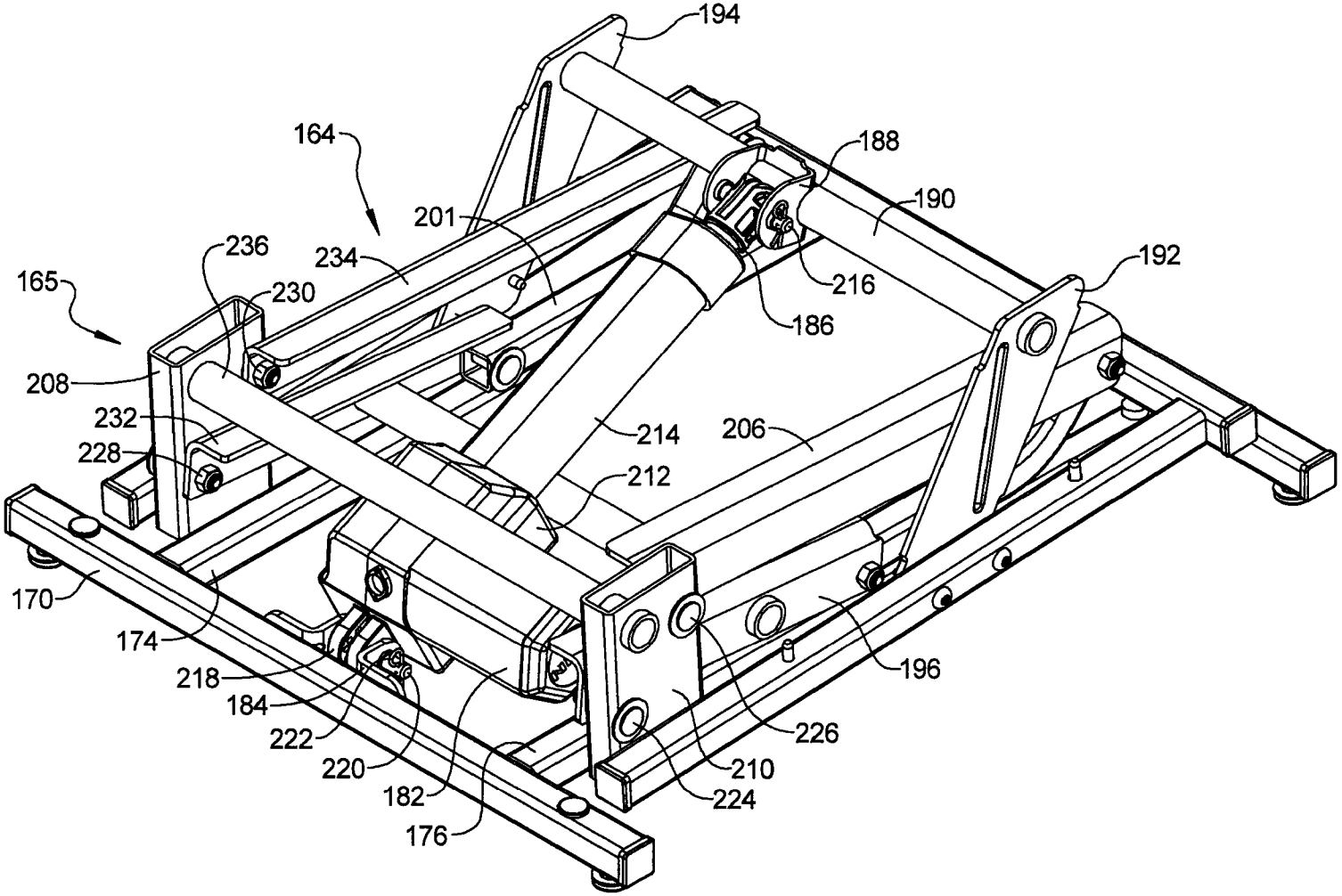
FIG. 26 is a front left perspective view of a lower portion of the mechanism of FIG. 21.

Referring to FIG. 26, both third and fourth rotation links 232, 234 are rotatably connected to a rectangular shaped tube member 208 connected to structure of stiffening tube assembly 165. The motor 182 is connected to a drive housing 212 which directly supports the motor 182 and contains internal gears. A shaft housing 214 is directly connected to the drive housing 212, and the extension shaft 186 is extensible and retractable from the shaft housing 214 during operation of the gears of drive housing 212. Extension shaft 186 is shown in its fully retracted position and positioned therefore substantially within the shaft housing shaft housing 214 with the mechanism 164 in the normal or upright position. Extension shaft 186 is rotatably pinned using a pin 216 to the opposed flanges of coupling bracket 188. A forward facing end of the drive housing 212 is connected using a clevis 218, a clevis pin 220, and a lock pin 222 to the motor mount bracket 184, which is fixed to the first frame member 170. Use of clevis 218 and clevis pin 220 allows the drive housing 212 to rotate during axial extension or return of extension shaft 186.

A rotational fastener 224 is used to connect a second end of first rotation link 196 to tube member 210. Similarly, a rotational fastener 226 is used to connect a second end of second rotation link 206 to tube member 210. Similar rotational fasteners 228, 230 connect a third rotation link 232 and a fourth rotation link 234 to tube member 208 and at opposite ends of second frame support tube 201 which mimics the first frame support tube 200. The third and fourth rotation links 232, 234 together define a second set of rotation links. A cross tube 236 is fixed to each of the tube members 208, 210 to stiffen a forward end of stiffening tube assembly 165.

Referring to FIG. 27 and again to FIG. 26, similar to first frame support tube 200, second frame support tube 201 includes an upward directed bend 202' at a furniture member rear facing end, which elevates the position of a second rotational fastener 204' above first rotational fastener 198'. The portion of mechanism 164 associated with lift operation is shown in the full lift position, after full extension of extension shaft 186. Stiffening tube assembly 165 is provided in part to increase side-to-side and lifting stiffness of the mechanism. Stiffening tube assembly 165 further includes parallel first and second side stiffening tubes 238, 240, each having one of the tube members 208, 210 fixed to a forward end. A rear stiffening tube 242 is fixed to both first and second side stiffening tubes 238, 240 and is oriented parallel to first and second frame members 170, 172. A brace tube 244 is also fixed at opposite ends to the first and third rotation links 196, 232. Fasteners, such as fasteners 246, are used to fix each of the first and second support brackets 192, 194 to their respective first or second side stiffening tubes 238, 240.

Figure 28:
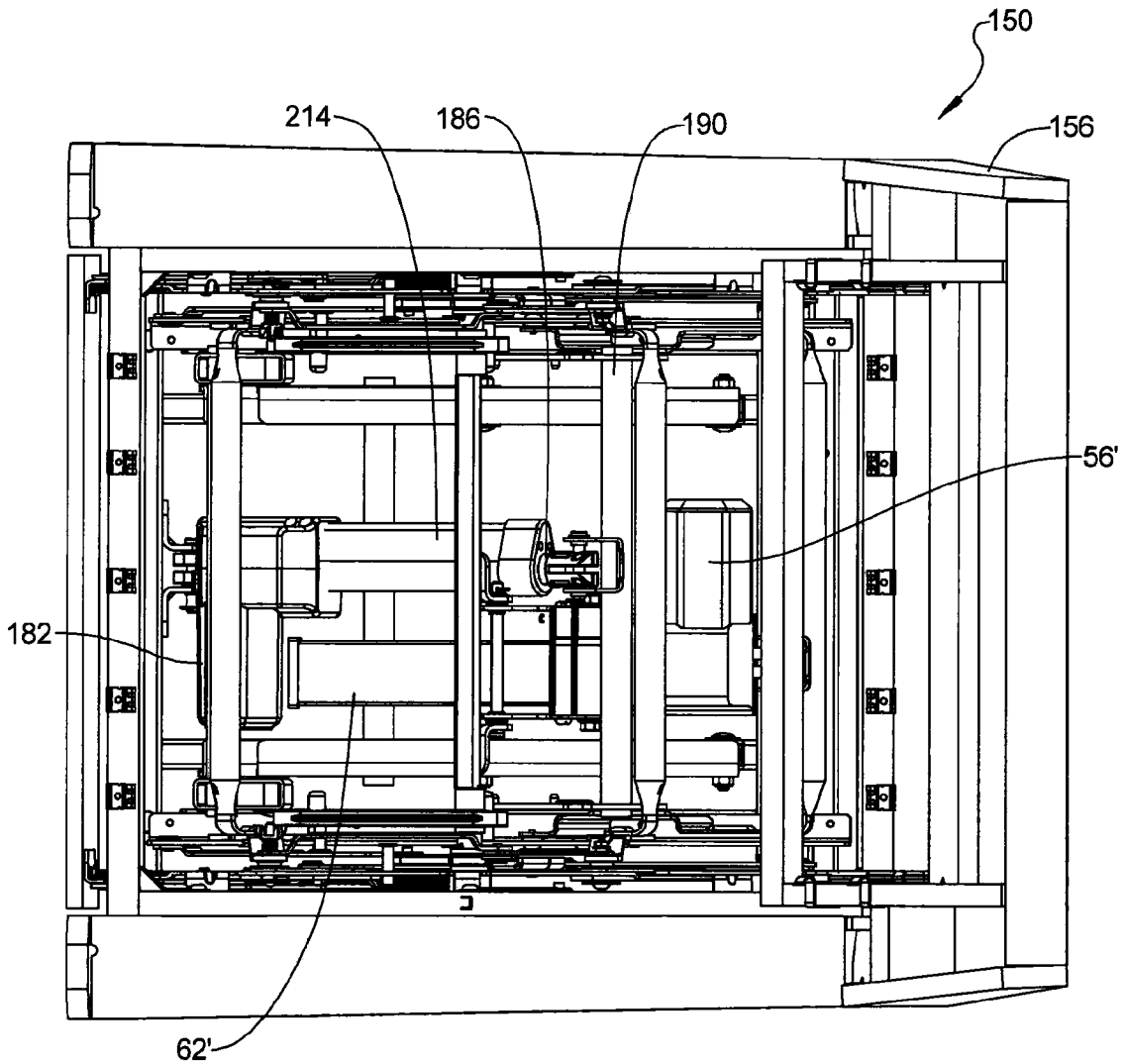
FIG. 28 is a top plan view of the furniture member and mechanism of FIG. 21.

Referring to FIG. 28 and again to FIGS. 3 and 26, the furniture member upright position is shown for furniture member 150. Motor 182 is oppositely facing with respect to motor 56'. In furniture member 150, motor 56' is reversed from its orientation with respect to furniture member 10 and therefore faces toward an occupant's right hand side. In furniture member 150, the shaft housing 214 is positioned substantially parallel to the orientation of slide frame 62'. The motor 56' and slide frame 62' in furniture member 150 are moved toward the occupant's left side of the lateral centerline 55 aligned position, shown in FIG. 3 for furniture member 10, to provide space for motor 182 and shaft housing 214.

Referring to FIGS. 25-28, operation of motor 182 rotates internal gears (not shown) within drive housing 212 that causes axial extension of extension shaft 186. Torque tube 190 is induced to lift upwardly as the first and third rotation links 196, 232 and second and fourth rotation links 206, 234 rotate. Axial extension of extension shaft 186 continues until the fully forward lift position (shown in FIGS. 22, 24, 25 and 27) is reached. According to several aspects, the first motor 182 acts in only a first powered direction to axially extend the extension shaft 186, with the extension shaft 186 self-returning into the shaft housing shaft housing 214 by the weight of the occupant and of the furniture member 150. According to further aspects, the first motor 182 can act in both a first powered direction to axially extend the extension shaft 186 and a second oppositely powered direction to retract the extension shaft 186.

Referring to FIG. 29 and again to FIGS. 21-28 and to FIG. 2, the lift recliner chair 150 moves away from the wall surface 46 in a direction "P" during a recline motion and includes base frame 160 (only partially visible in FIG. 29) supported on the floor surface 40. The moveable seat section or base member 152 attached to the base frame 160 has an attached seat upholstery section 248. The back rest section 156 is moveably connected to the seat section 152 and has an attached back upholstery section 250. The ottoman section or leg rest assembly 158 is connected to and is extendable from the seat section 152. A chair body section 252 includes each of the seat section 152, the back rest section 156, and the ottoman 158. The chair body section 252 or seat section tilts during ottoman 158 extension, tilts during recline of the back rest section 156, and both raises and tilts during a lift operation to a chair lift position (shown and described in Reference to FIG. 22) by actuation of an actuator means including first and second individual actuators as motors 56', 182.

The first actuator (motor 182) has a first range of movement operating to lift and tilt both the seat section 152 and the chair body section 252 to an occupant preferred position of egress, wherein a maximum seat angle (equivalent to lift angle δ shown in FIG. 25) measured from the seat upholstery section 248 to the floor surface 40 is approximately 12°. A minimum amount of lift as measured from an intersection 254 between a rear of seat upholstery section 248 and the back upholstery section 250 at a chair rest position (shown in FIG. 29) and at the intersection 254 of the rear of seat upholstery section 248 and the back upholstery section 250 at the chair lift position (shown in FIG. 25) is 12 inches.

According to several aspects, the first actuator (motor 182) cannot operate until the second actuator (motor 56') reaches a fully retracted condition. According to other aspects, each of the first and second actuators (motors 182, 56') can be stopped at any point in the range of movement. According to further aspects, the second actuator (motor 56') cannot operate until the first actuator (motor 182) reaches a fully retracted condition. In an initial operation of the second actuator, motor 56' provides a range of movement of the chair back section 156 from the fully reclined position (similar to FIG. 10) in the direction "P" to the upright position shown in FIG. 29, and simultaneously moves the seat section 152 and the chair body section 252 towards the wall surface 46 in a direction "Q", and subsequent operation of the second actuator 56' moves the extendable ottoman section 158 and simultaneously de-angles each of the seat section 152, the chair body section 252, and the back section 156, thereby providing a wall proximity position (similar to FIG. 7) when second actuator 56' is fully retracted of a maximum of 6 inches measured from a top rearmost point 42 of the back frame 156 to the wall surface 46.

Figure 29:
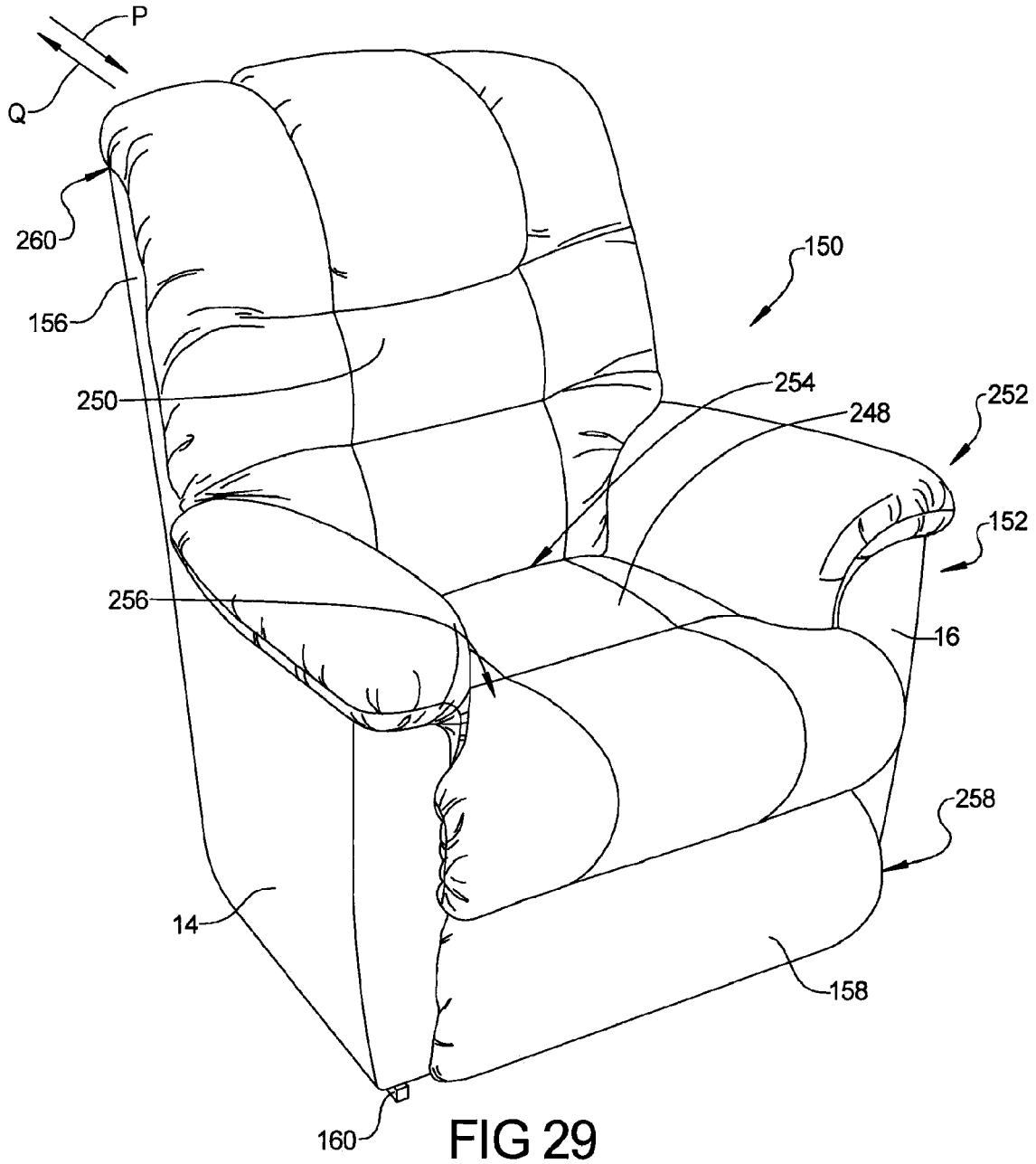
FIG. 29 is a front left perspective view of an upholstered furniture member of the present disclosure.

According to several aspects, the extendable ottoman section 158 extends forward of the seat section 152 a minimum of 19 inches, measured from the front lower corner 166 of the seat section 152 to a furthest forward position of the ottoman section 158 and above the seat section 152 a minimum of 2 inches measured from a top 256 of the seat section 152 and a top edge 258 of the extendable ottoman section 158 (shown in FIG. 29 in the ottoman retracted position). According to other aspects, the seat section 152, the chair body section 252, and the back section 156 tilt a minimum of 4.5° when the ottoman section 158 is fully extended.

According to other aspects, the first actuator, motor 182, has a range of movement that lowers and de-angles the seat section 152 and the chair body section 252 to an occupant selected sitting position (similar to FIG. 7) and a pitch of the seat frame section 162 measured with respect to the floor surface 40 ranges between approximately 6° to 10° rearward tilt. According to further aspects, the second actuator, motor 56', has a range of movement including an initial displacement of the chair back section 156 from a fully reclined position (similar to FIG. 10) to an upright position (shown in FIG. 29), and which simultaneously displaces the seat section 152 and the chair body section 252 towards the wall surface 46. The second actuator, motor 56', can also include a subsequent movement that displaces the extendable ottoman section 158 and simultaneously de-angles the seat section 152, the chair body section 252, and the back section 156, thereby providing a wall proximity position (similar to FIG. 10) of the lift recliner chair 150 at a fully retracted position of second motor 56', establishing a maximum of 6 inches measured from a top rear edge 260 of the back frame to the wall surface 46.

Example embodiments are provided so that this disclosure will be thorough and will fully convey the scope to those who are skilled in the art. Numerous specific details are set forth, such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms, as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member having an occupant lift position, comprising:

a base frame including a first frame member having a first frame support tube fixed thereto and a second frame member having a second frame support tube fixed thereto;

a mechanism connected to the base frame including:

a motor connected to the base frame; and a torque tube connected to first and second support brackets and to the motor;

a stiffening tube assembly having first and second side stiffening tubes, the first frame support tube connected to the first side stiffening tube and the second frame support tube connected to the second side stiffening tube; and multiple rotation links including a first set rotatably connected to the first frame support tube and to the first side stiffening tube, and a second set rotatably connected to the second frame support tube and to the second side stiffening tube, the multiple rotation links allowing rotation of the mechanism to at least a forward lift position by operation of the motor acting to displace the torque tube and thereby to forwardly rotate and lift the first and second side stiffening tubes, wherein the first set of rotation links includes first and second rotation links rotationally connected at opposite ends of the first frame support tube, and the second set of rotation links includes third and fourth rotation links rotationally connected at opposite ends of the second frame support tube.

2. The furniture member having an occupant lift position of claim 1, wherein the first and second frame support tubes each include an upward bend at a rear facing end elevating a position of a rotational fastener positioned at the rear facing end above a rotational fastener positioned at a front facing end.

3. The furniture member having an occupant lift position of claim 2, wherein:

the first and third rotation links are rotatably connected to the rotational fastener at the front facing end; and the second and fourth rotation links are rotatably connected to the rotational fastener at the rear facing end.

4. The furniture member having an occupant lift position of claim 2, wherein the rotational fastener at the front facing end of each the first and second frame support tubes is positioned at approximately a mid-span of the first and second frame members.

5. The furniture member having an occupant lift position of claim 1, further including:

a first tube member fixed to the first side stiffening tube, the third and fourth rotation links rotatably connected to the first tube member; and a second tube member fixed to the second side stiffening tube, the first and second rotation links rotatably connected to the second tube member.

6. The furniture member having an occupant lift position of claim 1, wherein the frame support tube of each of the first and second frame members is fixedly connected to an upward directed face of the first and second frame members.

7. The furniture member having an occupant lift position of claim 1, further including:

an extension shaft positioned in a shaft housing, the shaft housing connected to the motor, the extension shaft extensible from the shaft housing by operation of the motor; and a coupling bracket fixed to the torque tube and rotatably connected to the extension shaft.

8. The furniture member having an occupant lift position of claim 1, further including a motor mount bracket fixedly connected to a frame member of the base frame, and a clevis pin rotatably connecting the motor to the motor mount bracket allowing the motor to rotate during operation.

9. The furniture member having an occupant lift position of claim 1, further including a second mechanism supported by the stiffening tube assembly, the second mechanism having a second motor actuated to displace each of a leg rest mechanism and a seat back of the furniture member.

10. A furniture member having an occupant lift position, comprising:

a base frame including a first frame member having a first frame support tube fixed thereto and a second frame member having a second frame support tube fixed thereto, each of the first and second frame support tubes having an upward directed bend at a rear facing end thereof;

a mechanism connected to the base frame including:

a motor; and a torque tube connected to first and second support brackets and to the motor such that the torque tube is displaced by operation of the motor;

a stiffening tube assembly having first and second side stiffening tubes, the first frame support tube connected to the first side stiffening tube and the second frame support tube connected to the second side stiffening tube; and a first rotation link rotatably connected to a front facing end of the first frame support tube and a second rotation link rotatably connected to the upward directed bend of the first frame support tube; a third rotation link rotatably connected to a front facing end of the second frame support tube and a fourth rotation link rotatably connected to the upward directed bend of the second frame support tube; the multiple rotation links allowing rotation of the mechanism to at least a forward lift position by operation of the motor acting to displace the torque tube and thereby to displace the first and second side stiffening tubes.

11. The furniture member having an occupant lift position of claim 10, wherein the first and third rotational links are shorter than the second and fourth rotational links.

12. The furniture member having an occupant lift position of claim 11, further including a first rotational fastener at a forward facing end of each of the first and second frame support tubes rotationally connecting the first and third rotational links to one of the first and second frame support tubes.

13. The furniture member having an occupant lift position of claim 12, wherein the first rotational fastener is positioned at approximately a mid-span in a front-to-back orientation of the first and second frame members.

14. The furniture member having an occupant lift position of claim 12, further including a second rotational fastener positioned rearward of the first rotational fastener at a rearward facing end of the upward directed bend of the first and second frame support tubes rotationally connecting one of the second and fourth rotational links to one of the first and second frame support tubes.

15. The furniture member having an occupant lift position of claim 12, wherein the first and second frame members and the first and second frame support tubes are rectangular shaped and each of the first and second frame support tubes is fixedly connected to an upward directed face of one of the first and second frame members.

16. A furniture member having an occupant lift position, comprising:

a base frame supporting the furniture member on a floor surface, the base frame including a first frame member having a first frame support tube fixed thereto and a second frame member having a second frame support tube fixed thereto, each of the first and second frame support tubes having an upward directed bend at a rear facing end thereof;

a first mechanism, including:

a first motor rotatably connected to the base frame; and a torque tube displaced by operation of the first motor;

a stiffening tube assembly having first and second side stiffening tubes, the first frame support tube connected to the first side stiffening tube and the second frame support tube connected to the second side stiffening tube;

a second mechanism supported by the stiffening tube assembly, the second mechanism having a second motor; and multiple rotation links including a first set rotatably connected to the first frame support tube and to the first side stiffening tube, and a second set rotatably connected to the second frame support tube and to the second side stiffening tube, the multiple rotation links allowing rotation of the mechanism to at least a forward lift position by operation of the first motor acting to displace the torque tube and thereby to forwardly rotate and lift the first and second side stiffening tubes.

17. The furniture member having an occupant lift position of claim 16, further including:

the multiple rotation links including first and second rotation links each rotatably connected to a forward end of one of the first or second frame support tubes; and a support tube fixedly and non-rotationally connected at opposite ends to each of first and second rotation links.

18. The furniture member having an occupant lift position of claim 17, further including a rotational fastener rotatably connecting each of the first and second rotation links to one of the first and second support brackets such that the first and second support brackets are displaced when the first and second rotation links rotate during operation of the first motor.

19. The furniture member having an occupant lift position of claim 16, wherein the multiple rotation links further include third and fourth rotation links each rotatably connected to the bend of one of the first or second frame support tubes such that the third and fourth rotation links are positioned rearward of the first and second rotation links.

20. The furniture member having an occupant lift position of claim 16, further including:

a drive housing connected to the first motor;

a shaft housing directly connected to the drive housing;

an extension shaft positioned in the shaft housing, the extension shaft extensible from the shaft housing by operation of the first motor; and the first motor acting in only a first powered direction to axially extend the extension shaft, the extension shaft self-returning into the shaft housing.

21. A lift recliner chair that moves away from a wall surface during a recline motion, comprising:

a base frame supported on a floor surface;

a moveable seat section attached to the base frame having an attached seat upholstery section;

a back rest section moveably connected to the seat section and having an attached back rest upholstery section;

an ottoman section connected to and extendable from the seat section; and a chair body section including each of the seat section, the back rest section, and the ottoman, the chair body section tilting during ottoman extension, tilting during recline of the back rest section, and both raising and tilting during a lift operation to a chair lift position by actuation of an actuator means having first and second individual actuators, wherein the first actuator has a first range of movement operating to lift and tilt the seat section and the chair body section to an occupant preferred position of egress, and wherein the first actuator cannot operate until the second actuator reaches a fully retracted condition.

22. The lift recliner chair of claim 21, wherein a maximum seat angle measured from the seat frame upholstery section to the floor surface is approximately 12°, and a minimum amount of lift as measured from an intersection between the rear seat upholstery section and the back upholstery section at a chair rest position and at an intersection of the rear seat upholstery section and the back upholstery section at the chair lift position is 12 inches.

23. The lift recliner chair of claim 22, wherein the second actuator cannot operate until the first actuator reaches a fully retracted condition.

24. The lift recliner chair of claim 21, wherein each of the first and second actuators can be stopped at any point in the range of movement.

25. The lift recliner chair of claim 21, wherein an initial operation of the second actuator provides a range of movement of the chair back section from a fully reclined position to an upright position, and simultaneously moves the seat section and the chair body section towards a wall surface, and subsequent operation of the second actuator moves the extendable ottoman section and simultaneously de-angles each of the seat section, the chair body section, and the back section, thereby providing a wall proximity position when fully retracted of a maximum of 6 inches measured from a top rear edge of the back frame to the wall surface.

26. The lift recliner chair of claim 25, wherein the extendable ottoman section extends forward of the seat section a minimum of 19 inches measured from a front of the seat section to a furthest forward position of the ottoman section, and above the seat section a minimum of 2 inches measured from a top of the seat section and a top edge of the extendable ottoman section.

27. The lift recliner chair of claim 25, wherein the seat section, chair body section and back section tilt a minimum of 4.5° when the ottoman section is fully extended.

28. The lift recliner chair of claim 21, wherein the first actuator has a range of movement that lowers and de-angles the seat section and the chair body section to an occupant selected sitting position and wherein a pitch of the seat frame section measured with respect to the floor surface ranges between approximately 6° to 10° rearward tilt.

29. The lift recliner chair of claim 21, wherein the second actuator has a range of movement including an initial displacement of the chair back section from a fully reclined to an upright position, and which simultaneously displaces the seat section and the chair body section towards the wall surface, and includes a subsequent movement that displaces the extendable ottoman section and simultaneously de-angles the seat section, the chair body section, and the back section, thereby providing a wall proximity position of the lift recliner chair at a fully retracted position having a maximum of 6 inches measured from a top rear edge of the back frame to the wall surface.

* * * * *